US011926018B2

(12) United States Patent
Ito et al.

(10) Patent No.: US 11,926,018 B2
(45) Date of Patent: Mar. 12, 2024

(54) APPARATUS FOR POLISHING AND METHOD OF POLISHING

(71) Applicant: EBARA CORPORATION, Tokyo (JP)

(72) Inventors: Masayoshi Ito, Tokyo (JP); Hisanori Matsuo, Tokyo (JP); Itsuki Kobata, Tokyo (JP); Takuya Moriura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 182 days.

(21) Appl. No.: 17/314,573

(22) Filed: May 7, 2021

(65) Prior Publication Data

US 2021/0347010 A1 Nov. 11, 2021

(30) Foreign Application Priority Data

May 11, 2020 (JP) ..... 2020-083404

(51) Int. Cl.
*B24B 57/02* (2006.01)
*B24B 37/005* (2012.01)
(Continued)

(52) U.S. Cl.
CPC ..... *B24B 57/02* (2013.01); *B24B 37/005* (2013.01); *B24B 37/042* (2013.01); *B24B 37/107* (2013.01); *B24B 37/32* (2013.01)

(58) Field of Classification Search
CPC ..... B24B 53/017; B24B 53/005; B24B 57/02; B24B 37/005; B24B 37/042; B24B 37/34; B24B 7/228
See application file for complete search history.

(56) References Cited

U.S. PATENT DOCUMENTS 5,709,593 A * 1/1998 Guthrie ..... B24B 37/04 451/286
6,283,840 B1 * 9/2001 Huey ..... B24B 57/02 451/288
(Continued)

FOREIGN PATENT DOCUMENTS

JP H10-217114 A 8/1998
JP H11-114811 A 4/1999
(Continued)

*Primary Examiner* — Joel D Crandall
(74) *Attorney, Agent, or Firm* — PEARNE & GORDON LLP

(57) ABSTRACT

There is provided an apparatus for polishing, comprising a polishing table configured to support and rotate a polishing pad; a holder configured to hold an object and press the object against the polishing pad; a polishing solution supply device provided with a contact member and configured to supply a polishing solution to an opening in a bottom face of the contact member in a state that the contact member comes into contact with or is adjacent to the polishing pad, thereby spreading the polishing solution on the polishing pad, the polishing solution supply device causing at least part of used polishing solution returned by rotation of the polishing pad to be dammed up by the contact member and setting the contact member either in a direction of keeping the dammed up polishing solution on the polishing pad or in a direction of discharging the dammed up polishing solution, according to an angle of the polishing solution supply device with respect to a radial direction of the polishing pad; an arm linked with the polishing solution supply device; a rotating mechanism configured to rotate the polishing solution supply device with respect to the arm; and a controller configured to control the rotating mechanism to change the angle of the polishing solution supply device with respect to the radial direction of the polishing pad and thereby control a
(Continued)

discharge amount of the polishing solution by the contact member of the polishing solution supply device.

16 Claims, 26 Drawing Sheets

(51) Int. Cl.
*B24B 37/04* (2012.01)
*B24B 37/10* (2012.01)
*B24B 37/32* (2012.01)

(56) References Cited

U.S. PATENT DOCUMENTS 6,336,850 B1 1/2002 Wada et al.
7,052,374 B1 * 5/2006 Lu ..... B24B 37/04 451/60
8,845,395 B2 9/2014 Borucki et al.
2003/0068959 A1 * 4/2003 Kajiwara ..... B24B 57/02 451/41
2014/0273753 A1 * 9/2014 Matsuo ..... B24B 37/005 451/6
2016/0114459 A1 * 4/2016 Butterfield ..... B24B 1/00 156/345.12
2017/0148655 A1 * 5/2017 Kobayashi ..... B24B 49/105
2017/0297164 A1 * 10/2017 Kim ..... B24B 37/005
2017/0368663 A1 12/2017 Yang et al.
2020/0039029 A1 * 2/2020 Sotozaki ..... B24B 37/107
2020/0039031 A1 * 2/2020 Chen ..... B24B 49/14

FOREIGN PATENT DOCUMENTS

JP 2903980 B2 6/1999
JP 2019-520991 A 7/2019
KR 20060121380 A * 11/2006 ..... B24B 57/02
WO WO-2019131174 A1 * 7/2019 ..... A43D 1/025

* cited by examiner

Fig. 19

| | |
|---|---|
| θs | θa |
| θsi | θai |
| ・・・・ | ・・・ |
| θs1 | θa1 |
| θs2 | θa2 |
| θs3 | θa3 |
| ・・・ | ・・・・ |
| θsn | θan |

APPARATUS FOR POLISHING AND METHOD OF POLISHING

TECHNICAL FIELD

The present disclosure relates to an apparatus for polishing and a method of polishing.

BACKGROUND ART

In the manufacturing process of a semiconductor device, the planarization technology of the surface of the semiconductor device is of increasing significance. One known planarization technique is CMP (chemical mechanical polishing). This CMP uses a polishing apparatus to slide and polish a substrate such as a semiconductor wafer against a polishing pad with supplying a polishing solution (slurry) containing abrasive grains of, for example, silica ($SiO_2$) and/or ceria ($CeO_2$) to the polishing pad.

A polishing apparatus that performs the CMP process includes a polishing table configured to support a polishing pad and a substrate holding mechanism called a top ring, a polishing head or the like to hold the substrate. This polishing apparatus causes a polishing solution to be supplied from a polishing solution supply nozzle to the polishing pad and presses the substrate against the surface of the polishing pad (polishing surface) by a predetermined pressure. The substrate is slid against the polishing surface by rotating the polishing table and the substrate holding mechanism, so that the surface of the substrate is polished to a flat, specular surface.

The polishing solution used for the CMP apparatus is expensive, and an additional cost is required to treat the used polishing solution. It is accordingly required to reduce the use amount of the polishing solution, with a view to reducing the operating cost of the CMP apparatus and the manufacturing cost of the semiconductor device. It is also required to suppress or prevent the influence of the used polishing solution and by-products on the quality and/or the polishing rate of the substrate.

One of the measures to solve such problems is to provide a polishing apparatus configured to supply a polishing solution onto a polishing pad via a polishing solution supply device or a regulation mechanism in a pad-like shape or in a box-like shape placed on the polishing pad (as described in, for example, Patent Documents 1 to 5 referred to below). Such a polishing solution supply device or regulation mechanism presses a wiper, a tank in a surrounding shape or an injector against the polishing pad to regulate the flow of the polishing solution. More specifically, Japanese Unexamined Patent Publication No. H10-217114 (Patent Document 1) describes a configuration that uses a regulation mechanism serving as a wiper to evenly spread over a polishing agent supplied from a polishing agent supply mechanism onto a polishing surface to supply the polishing agent to a substrate. Japanese Patent No. 2903980 (Patent Document 2) describes a configuration that causes a polishing solution spreading from the center of a polishing table outward of the polishing table by a centrifugal force to climb over one side wall of a rectangular parallelepiped container and flow into the rectangular parallelepiped container and to be supplied from a polishing surface center side in the other side wall to a substrate.

Japanese Unexamined Patent Publication No. H11-114811 (Patent Document 3) describes a configuration that places a bottomless tank in a surrounding shape on a polishing surface to supply a polishing solution from a location between a tank wall and the polishing surface and presses the tank against the polishing surface by a pressing shaft. Japanese Unexamined Patent Publication No. 2019-520991 (Patent Document 4) describes a configuration brings a wiper blade into contact with a polishing surface and supplies a polishing solution from a location between the wiper blade and the polishing surface to a substrate holding position. In this configuration, an actuator is operated to press the wiper blade and regulate the pressing force of the wiper blade against the polishing surface.

U.S. Pat. No. 8,845,395 (Patent Document 5) describes an apparatus that uses a pad-type injector (supply device) provided with weights placed inside thereof to supply a polishing solution onto a polishing surface. This pad-type supply device is supported on the polishing surface by a rod connected with a support structure outside of a polishing table and is pressed against the polishing surface by its own weight to supply the polishing solution from a clearance between a bottom face and the polishing surface to a substrate holding position.

RELATED ART DOCUMENT

Patent Document

Patent Document 1: Japanese Unexamined Patent Publication No. H10-217114

Patent Document 2: Japanese Patent No. 2903980

Patent Document 3: Japanese Unexamined Patent Publication No. H11-114811

Patent Document 4: Japanese Unexamined Patent Publication No. 2019-520991

Patent Document 5: U.S. Pat. No. 8,845,395

SUMMARY OF INVENTION

The supply device or the regulation mechanism disclosed in the above patent documents is placed on the polishing surface during a polishing process, and the polishing solution and/or the polishing residue or the like is likely to be splashed and adhere to the surface and inside of the polishing solution supply device. The adhering polishing solution and/or polishing residue or the like is likely to be solidified on the surface or inside of the supply device and to fall off on the polishing surface. This may damage the surface of the substrate and may affect the polishing quality. The polishing apparatus is generally provided with a pad cleaning mechanism such as an atomizer or a high-pressure water rinsing device for the purpose of cleaning the surface of the polishing pad after the polishing process. Part of the polishing solution and/or the polishing residue or the like adhering to the supply device is removed in the process of cleaning the pad by this cleaning mechanism. This cleaning mechanism, however, performs cleaning on the polishing pad, so that the removed polishing solution and/or polishing residue or the like is likely to remain on the polishing pad. The remaining polishing solution and/or polishing residue or the like is likely to damage a next substrate that is a next object to be polished. There is accordingly a requirement to remove the polishing solution and/or the polishing residue or the like adhering to the supply device in a location outside of the polishing pad.

The supply device or the regulation mechanism disclosed in the above patent documents regulates the flow of the polishing solution by pressing the supply device against the polishing pad. A friction torque is generated between the polishing solution supply device and the polishing pad by rotation of the polishing table during a polishing process. This friction torque is likely to cause inclination or vibration of the supply device and thereby cause the non-uniform contact state of the supply device with the polishing pad. In this case, the non-uniform regulation of the flow of the polishing solution varies the polishing performance. In order to stabilize the polishing performance, there is also a requirement to suppress/prevent the non-uniform contact state of the supply device with the polishing pad caused by a friction torque in the polishing process. Moreover, in order to reduce the operating cost of the polishing apparatus and the manufacturing cost of the semiconductor device, there is also a requirement to further reduce the use amount of the polishing solution. There is a further requirement to achieve both reduction of the use amount of the polishing solution and maintenance the polishing quality.

An object of the present disclosure is to provide a polishing solution supply system that solves at least part of the problems described above.

According to one aspect of the present disclosure, there is provided an apparatus for polishing configured to polish an object by using a polishing pad having a polishing surface. The apparatus for polishing comprises: a polishing table provided to be rotatable and configured to support and rotate the polishing pad; a holder configured to hold the object and press the object against the polishing pad; a polishing solution supply device provided with a contact member and configured to supply a polishing solution to an opening in a bottom face of the contact member in a state that the contact member comes into contact with or is adjacent to the polishing pad, thereby spreading the polishing solution on the polishing pad, the polishing solution supply device causing at least part of used polishing solution returned by rotation of the polishing pad to be dammed up or held back by the contact member and setting the contact member either in a direction of keeping the dammed up polishing solution on the polishing pad or in a direction of discharging the dammed up polishing solution, according to an angle of the polishing solution supply device with respect to a radial direction of the polishing pad; an arm linked with the polishing solution supply device; a rotating mechanism configured to rotate the polishing solution supply device with respect to the arm; and a controller configured to control the rotating mechanism to change the angle of the polishing solution supply device with respect to the radial direction of the polishing pad and thereby control a discharge amount of the polishing solution by the contact member of the polishing solution supply device.

According to one aspect, there is provided a method of polishing an object by using a polishing pad having a polishing surface and a polishing solution supply device placed on the polishing pad. The method of polishing comprises: supplying a polishing solution to an opening in a bottom face of a contact member of the polishing solution supply device to spread the polishing solution on the polishing pad in a state that the contact member comes into contact with or is adjacent to the polishing pad, causing at least part of used polishing solution returned by rotation of the polishing pad to be dammed up by the contact member, and keeping the dammed up polishing solution on the polishing pad and/or discharging the dammed up polishing solution, according to an angle of the polishing solution supply device with respect to a radial direction of the polishing pad; and controlling a discharge amount of the polishing solution by changing an angle and/or a position of the polishing solution supply device on the polishing pad, at least at a time of a pre-supply that supplies the polishing solution to the polishing pad prior to polishing of the object, or during polishing of the object.

BRIEF DESCRIPTION OF DRAWINGS

FIG. 19 illustrates an example of data configuration of the angle of the polishing solution supply device and the angle of the arm;

DESCRIPTION OF EMBODIMENTS

The following describes embodiments of the present disclosure with reference to drawings. In the attached drawings, identical or similar components are expressed by identical or similar reference signs. In the explanation of the respective embodiments, overlapping description with regard to the identical or similar components may be omitted. Characteristics and features described in each of the embodiments are applicable to the other embodiments so far as they are not incompatible with each other.

In the description hereof, the term "substrate" includes not only semiconductor substrates, glass substrates, liquid crystal substrates and printed circuit boards but magnetic recording media, magnetic recording sensors, mirrors, optical elements, micromachine elements or partially manufactured integrated circuits, and any other objects to be processed. The substrate may be in any of various shapes including polygonal shapes and circular shapes. Although the expressions such as "front face", "back face", "front", "back", "upper (on, above)", "lower (below)", "left", "right", "vertical" and "horizontal" are used in the description hereof, these expressions only indicate the positions and the directions on the sheet surfaces of the illustrative drawings for the purpose of explanation and may be different from the positions and the directions in the actual layout, for example, during use of the apparatus.

(General Configuration of Polishing Apparatus)

Figure 1:
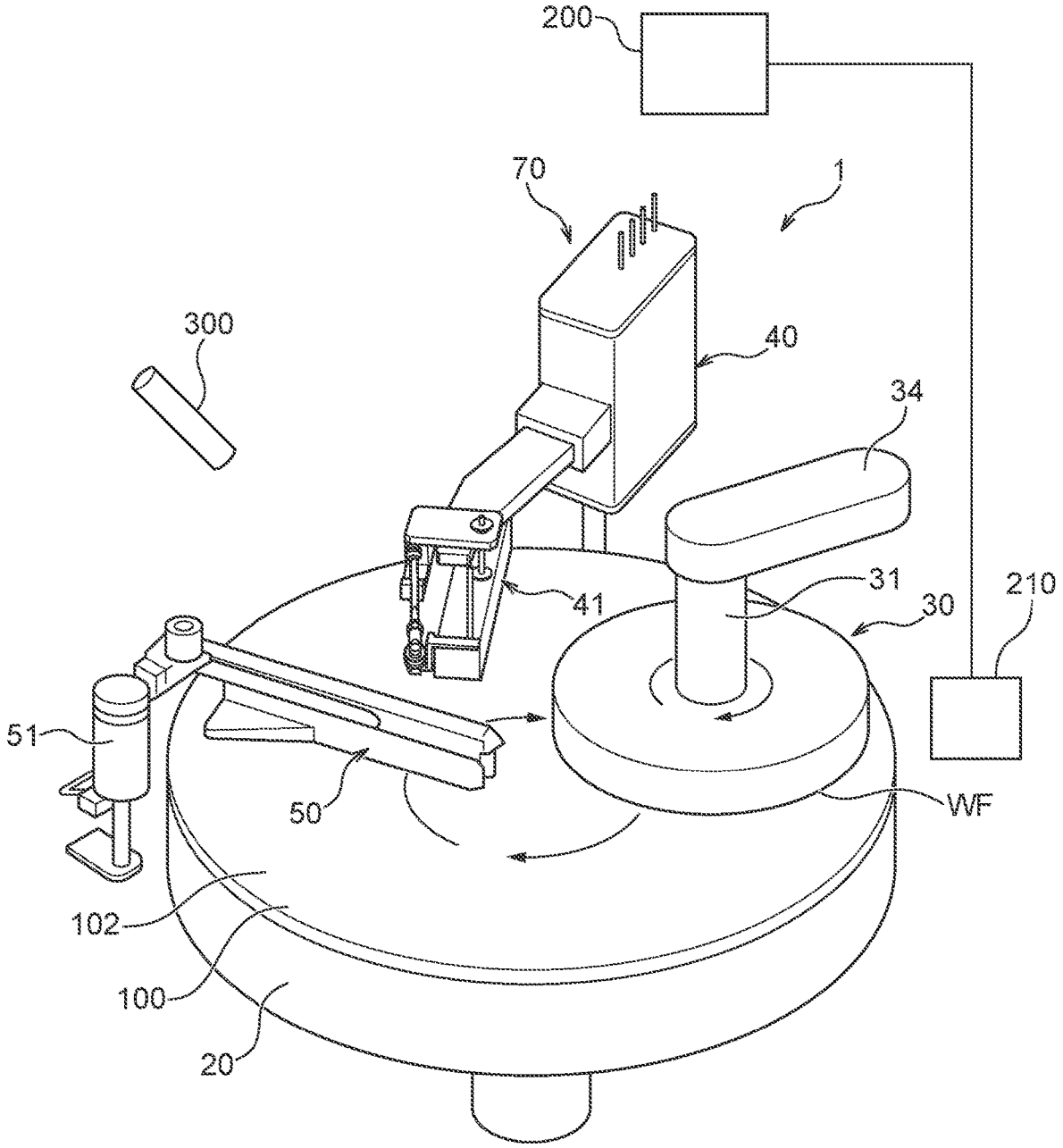
FIG. 1 is a diagram illustrating the schematic configuration of a polishing apparatus according to one embodiment of the present disclosure.

FIG. 1 is a diagram illustrating the schematic configuration of a polishing apparatus according to one embodiment of the present disclosure. A polishing apparatus 1 of the embodiment is configured to polish a substrate WF such as a semiconductor wafer as an object to be polished by using a polishing pad 100 having a polishing surface 102. As illustrated, the polishing apparatus 1 includes a polishing table 20 configured to support the polishing pad 100 and a top ring (substrate holder) 30 configured to hold the substrate and press the substrate against the polishing surface 102 of the polishing pad 100. The polishing apparatus 1 further includes a polishing solution supply system 40 configured to supply a polishing solution (slurry) to the polishing pad 100 and an atomizer 50 configured to spray a liquid such as pure water and/or a gas such as nitrogen onto the polishing surface 102 so as to wash away the used slurry, the polishing residue and the like.

The polishing table 20 is formed in a disk-like shape and is configured to be rotatable about a center axis of the disk-like shape as an axis of rotation. The polishing pad 100 is mounted to the polishing table 20 by pasting or the like. A surface of the polishing pad 100 forms the polishing surface 102. As the polishing table 20 is rotated by a non-illustrated motor, the polishing pad 100 is rotated integrally with the polishing table 20.

The top ring 30 has a lower face configured to hold the substrate WF as the object to be polished by vacuum suction or the like. The top ring 30 is configured to be rotatable along with the substrate by the power from a non-illustrated motor. The top ring 30 has an upper portion connected with a support arm 34 via a shaft 31. The top ring 30 is also configured to be movable in a vertical direction by motor driving via a non-illustrated air cylinder or ball bearing, so as to adjust the distance from the polishing table 20. This configuration enables the top ring 30 to press the substrate WF held thereby against the surface of the polishing pad 100 (the polishing surface 102). Furthermore, the top ring 30 has a non-illustrated airbag that is placed inside thereof and that is divided into a plurality of areas. A pressure is applied to the substrate WF from its back face by supplying a pressure of any fluid such as the air to the respective airbag areas. Moreover, the support arm 34 is configured to be turnable by a non-illustrated motor, so as to move the top ring 30 in a direction parallel to the polishing surface 102. According to the embodiment, the top ring 30 is configured to be movable between a non-illustrated substrate receiving position and an upper position above the polishing pad 100 and is also configured to change a pressing position where the substrate WF is pressed against the polishing pad 100. In the description below, the pressing position (holding position) where the substrate WF is pressed by the top ring 30 is also referred to as "polishing area".

The polishing solution supply system 40 includes a polishing solution supply device 41 serving to supply the polishing solution (slurry) to the polishing pad 100 and is configured to make the polishing solution supply device 41 movable between a supply position on the polishing surface 102 and a refuge position on outside of the polishing table 20. The polishing solution supply system 40 is also configured to change the supply position of the polishing solution supply device 41 on the polishing surface 102. The details of the polishing solution supply system 40 will be described later.

The atomizer 50 is a device configured to spray a liquid and/or a gas (for example, pure water and/or nitrogen) to the polishing surface 102 from one or a plurality of nozzles and wash away the used slurry, polishing residue and the like. The atomizer 50 is connected with a lifting and/or turning mechanism 51. The atomizer 50 is configured to be movable between an operating position on the polishing surface 102 and a refuge position on outside of the polishing table 20 by the lifting and/or turning mechanism 51. The atomizer 50 is also configured to change the operating position and height on the polishing surface 102 by the lifting and/or turning mechanism 51.

The polishing apparatus 1 further includes a controller 200 configured to control the general operations of the polishing apparatus 1. The controller 200 may be configured by a microcomputer that includes a CPU, memories and the like and that uses software such as a polishing recipe and/or information of machine parameters of relevant equipment input in advance to achieve desired functions, may be configured by a hardware circuit that performs exclusive arithmetic processing, or may be configured by a combination of the microcomputer and the hardware circuit that performs exclusive arithmetic processing.

The polishing apparatus 1 polishes the substrate WF by a procedure described below. The procedure first rotates the polishing pad 100, while rotating the top ring 30 with the substrate WF held by the lower surface thereof. The procedure uses the polishing solution supply system 40 described later in this state to supply the slurry. More specifically, prior to supply of the slurry, the polishing solution supply device 41 is moved to a predetermined position on the polishing surface 102 of the polishing pad 100 by a turning operation of an arm 60 that is engaged with the polishing solution supply device 41, by means of a lifting turning mechanism 70 (described later). Simultaneously with a start of supply of the slurry, the polishing solution supply device 41 is subsequently lowered to the polishing surface 102 of the polishing pad 100 by an up/down operation of the lifting turning mechanism 70, so as to come into contact with the polishing surface 102. The relationship between the turning stop and lowering operations and the supply start operation of the polishing solution supply device 41 is not limited to the above description but may be set appropriately according to the specifications of the device. The substrate WF held by the top ring 30 is then pressed against the polishing surface 102. This causes the substrate WF and the polishing pad 100 to be moved relative to each other in the state that the surface of the substrate WF is in contact with the polishing pad 100 in the presence of the slurry and thereby polishes the substrate. After conclusion of polishing, the polishing solution supply device 41 is lifted up by the lifting turning mechanism 70, is subsequently moved to the refuge position on outside of the polishing pad 100 by the turning operation of the arm 60 by means of the lifting turning mechanism 70, and is then cleaned by using a cleaning nozzle 300. This sequence of operations may be set in advance by the polishing recipe and/or the preset machine parameters provided in the controller 200.

The configuration of the polishing apparatus 1 described above is merely one example, and another configuration may be employed. For example, the polishing apparatus 1 may further include a dresser and/or a temperature regulation device or mechanism and may exclude the atomizer. The dresser serves to perform surface conditioning of the polishing surface 102 of the polishing pad 100 during an interval between polishing operations or in the course of polishing. The dresser presses a disk that has a smaller diameter than the diameter of the polishing pad 100 and that has diamond abrasive grains placed thereon, against the polishing surface 102 of the polishing pad 100 and moves the disk relative to the polishing pad 100, so as to condition the entire polishing surface 102 of the polishing pad 100. For example, the temperature regulation mechanism may be connected with the polishing solution supply device to heat up or cool down the slurry itself. In another example, the temperature regulation mechanism may be provided with a heat exchanger placed near to the polishing surface 102 of the polishing pad 100 and may be configured to heat up or cool down the heat exchanger by using a heater placed inside of the heat exchanger or by supplying either of hot water or cold water or a mixture of hot water and cold water at a predetermined mixing ratio to the heat exchanger, and to transmit the temperature of the heated or cooled heat exchanger to the polishing surface 102 and thereby regulate the temperature of the polishing surface 102. In another example, the temperature regulation mechanism may be configured to inject and supply a gas (for example, the air, $N_2$ or the like) to the polishing surface 102 of the polishing pad 100 to cool down the polishing surface 102.

(Polishing Solution Supply System)

Figure 2:
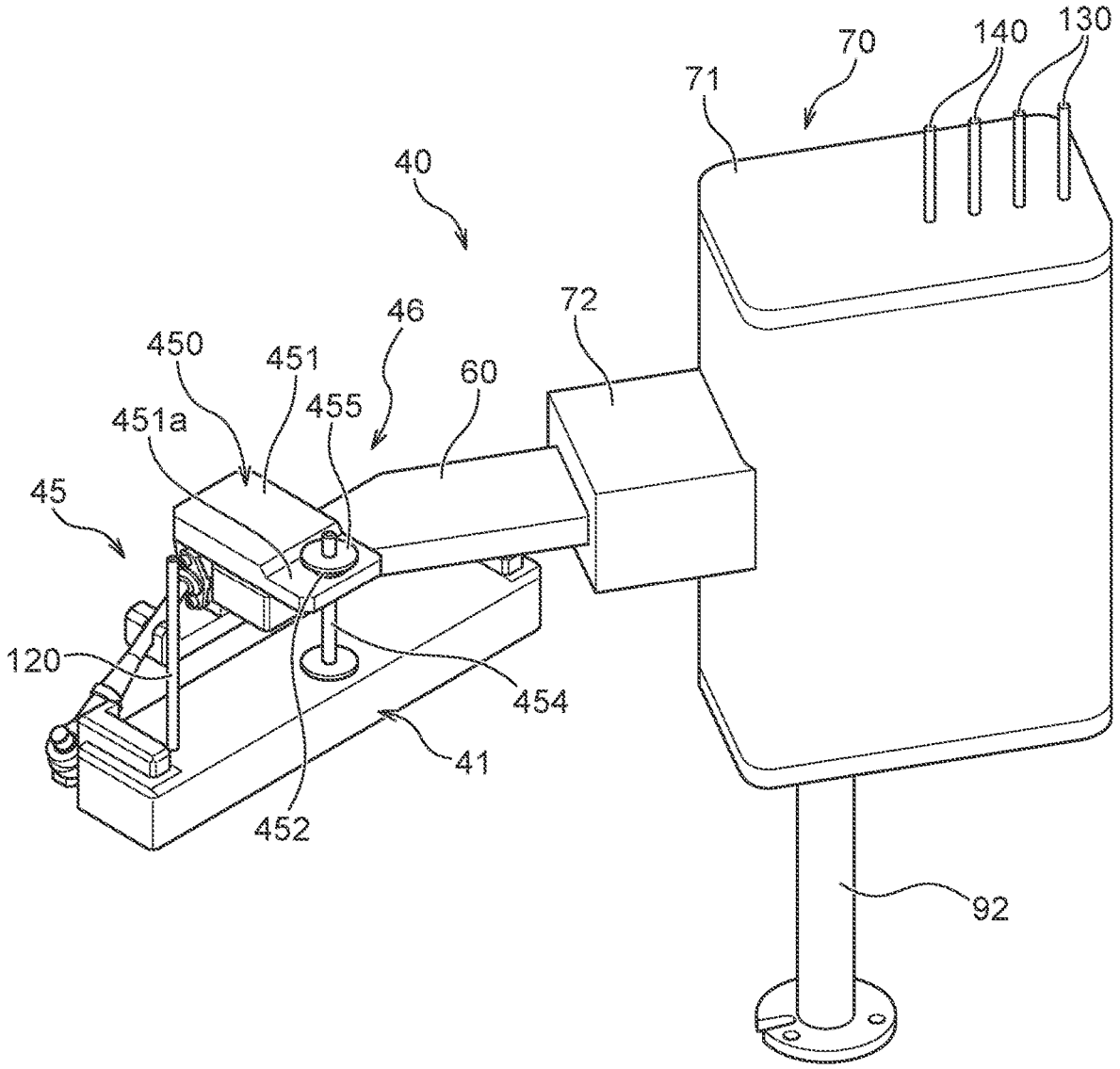
FIG. 2 is a perspective view illustrating a polishing solution supply system viewed from a downstream side thereof.
Figure 3:
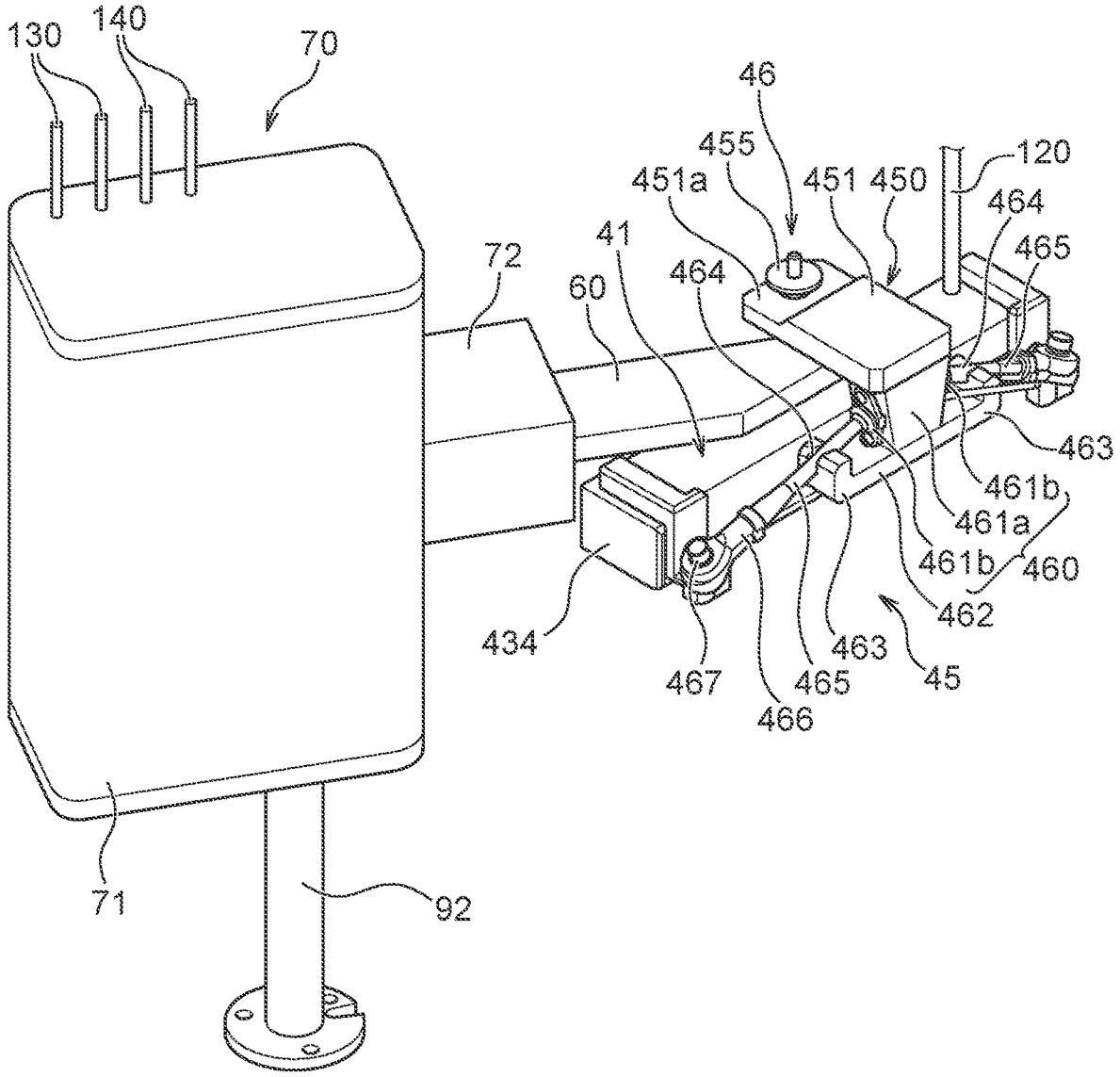
FIG. 3 is a perspective view illustrating the polishing solution supply system viewed from an upstream side thereof.
Figure 4:
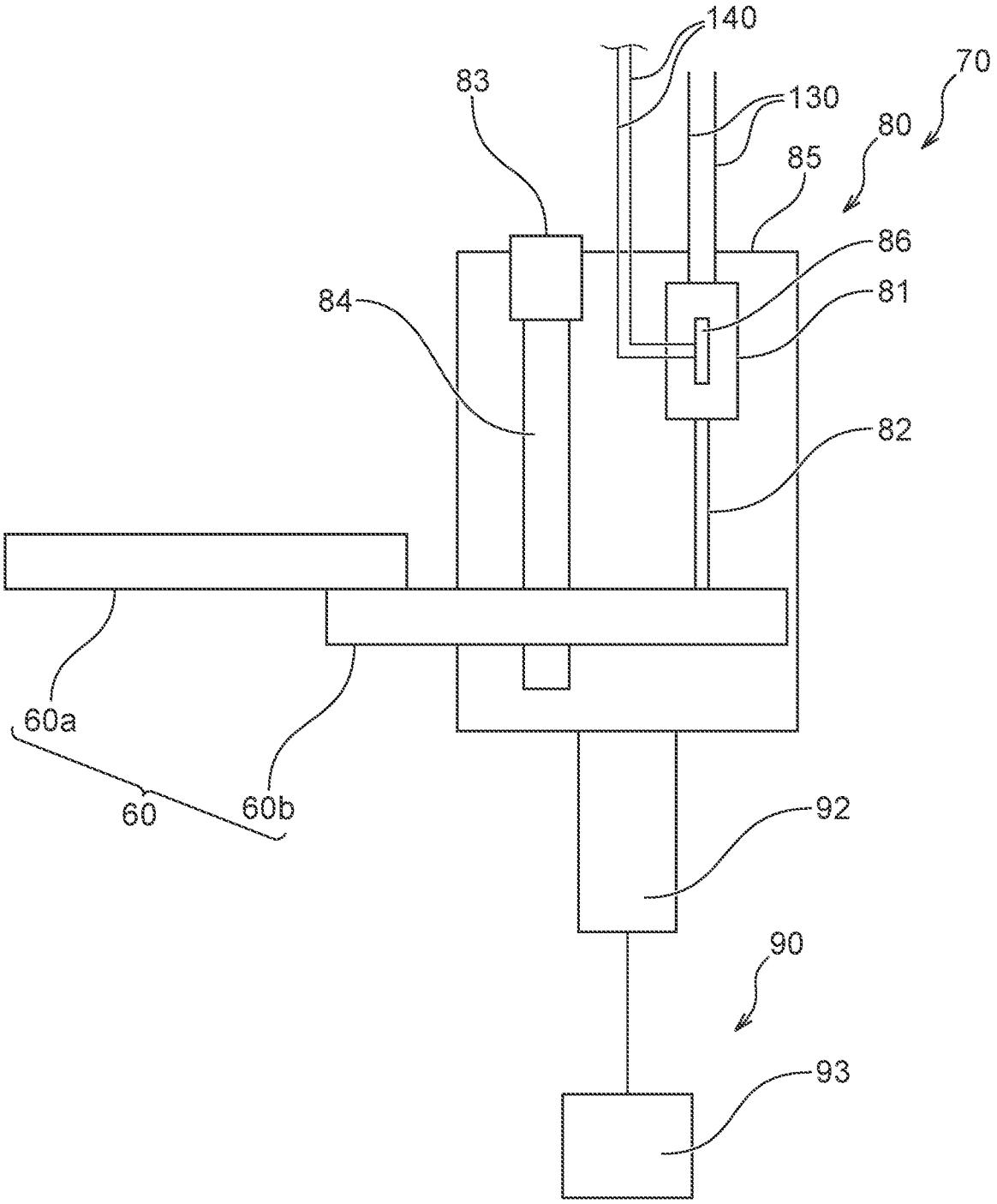
FIG. 4 is a diagram illustrating the configuration of a lifting mechanism.

FIG. 2 is a perspective view illustrating the polishing solution supply system viewed from a downstream side thereof. FIG. 3 is a perspective view illustrating the polishing solution supply system viewed from an upstream side thereof. FIG. 4 is a diagram illustrating the configuration of the lifting mechanism. In the description hereof, the upstream side and the downstream side denote an upstream side and a downstream side in the case where the polishing table 20 (the polishing pad 100) is rotated clockwise in FIG. 1.

As illustrated, the polishing solution supply system 40 includes the polishing solution supply device 41, the arm 60, and a following mechanism 45 and a suspending mechanism 46 provided to link the polishing solution supply device 41 with the arm 60. The polishing solution supply device 41 is configured to come into contact with the polishing surface 102 by the load of a weight (described later) provided inside of the polishing solution supply device 41. The contact pressure (load) of the polishing solution supply device 41 applied to the polishing surface 102 is adjustable by changing the load of the weight. In this illustrated example, the polishing solution supply device 41 is uniformly brought into contact with the polishing surface 102 by the load of the weight. Another technique may, however, be employed. For example, the polishing solution supply device 41 may be uniformly brought into contact with the polishing surface 102 by applying a fluid pressure to a contact member (described later) of the polishing solution supply device 41 via an elastic body such as an airbag. The expression of "bringing" the polishing solution supply device 41 "into contact with" the polishing surface 102 in the description hereof does not mean pressing the polishing solution supply device 41 to apply a pressure and even the unevenness of the polishing pad but means pressing the polishing solution supply device 41 to follow the unevenness of the polishing pad. The minimum requirement is thus merely the deadweight of the weight of the polishing solution supply device 41 (naturally including the weight of the contact member and the like included in the polishing solution supply device 41) or the fluid pressure via the elastic body such as the airbag.

The polishing solution supply device 41 is connected with a slurry supply line 120. The polishing solution supply device 41 serves to supply the slurry fed through the slurry supply line 120 from a device bottom face thereof onto the polishing surface 102. The following mechanism 45 and the suspending mechanism 46 serve to change the connecting state between the polishing solution supply device 41 and the arm 60. More specifically, the following mechanism 45 and the suspending mechanism 46 change the connecting state of the polishing solution supply device 41 with the arm 60 between a released state that the polishing solution supply device 41 is released from vertical motions of the arm 60 by the lifting turning mechanism 70 described later (i.e., released from the hold by the arm 60) and a locked state that the polishing solution supply device 41 is made to follow the vertical motions of the arm 60 (i.e., the state that the polishing solution supply device 41 is held by the arm 60). The arm 60 is extended from a base end portion thereof to a leading end portion thereof which the polishing solution supply device 41 is mounted to. In this illustrated example, the arm 60 is bent in the middle thereof, with a view to avoiding the interference with another unit and is extended toward a downstream side in a rotating direction of the polishing table in plan view. The arm 60 may not be bent but may be linearly arranged according to the specification of the apparatus. As shown in FIG. 4, the arm 60 may be configured to include a leading end side portion 60*a* and a base end portion 60*b* provided as separate members and linked with each other by means of any fixation means such as a bolt. The leading end side portion 60*a* and the base end portion 60*b* of the arm 60 may be formed integrally. In the case where the leading end side portion 60*a* and the base end portion 60*b* are provided as separate members, multiple different types of the leading end side portions 60*a* having different bending angles may be provided by taking into account the workability and/or the positioning property. Each of the different types of the leading end side portions 60*a* (arm) may be provided with a plurality of pin holes or a plurality of pins such as to be adjustable among a plurality of (for example, three) different angles relative to the base end portion 60*b*. This configuration allows for fine adjustment of the set angle in the leading end side portion 60*a* of an identical type.

(Lifting Turning Mechanism)

The base end portion 60*b* of the arm 60 is connected with the lifting turning mechanism 70 configured to lift up, lower, and turn the arm 60 as shown in FIG. 4. The lifting turning mechanism 70 includes the lifting mechanism 80 configured to lift up and lower the arm 60, and the turning mechanism 90 configured to turn the arm 60. The lifting mechanism 80 and the turning mechanism 90 are controlled by the controller 200.

In this illustrated example, the lifting mechanism 80 includes a lift cylinder 81 fixed to a frame 85, and the base end portion 60*b* of the arm 60 is fixed to an axis 82 of the lift cylinder 81. The lift cylinder 81 is configured to receive a supply of a fluid (a gas such as the air or a liquid such as hydraulic oil) through fluid lines 130 to advance or refuge the axis 82. The lift cylinder 81 has two chambers parted by, for example, a piston and arranged such that one of the fluid lines 130 is connected with one chamber and the other of the fluid lines 130 is connected with the other chamber. The lift cylinder 81 advances and refuges the axis 82 by introducing the fluid into one chamber and discharging the fluid from the other chamber and by introducing the fluid into the other chamber and discharging the fluid from one chamber. The arm 60 is configured to be moved in a vertical direction by advance and refuge of the axis 82 of the lift cylinder 81. The lifting mechanism 80 further includes a ball spline 83 configured to guide the vertical motions of the arm 60. The ball spline 83 is fixed to the frame 85. The base end portion 60*b* of the arm 60 is fit in an axis 84 of the ball spline 83, and the vertical motions of the arm 60 by the lift cylinder 81 are guided along the axis 84. The configuration of guiding the vertical motions of the arm 60 is not limited to the ball spline, but may be any other guide mechanism or may be omitted. A sensor 86 (for example, a magnetic sensor) is provided to detect a move of the axis 82 of the lift cylinder 81 and thereby detect the height of the arm 60. Electric cables 140 denote cables connected with the sensor. The sensor may, however, be omitted. The lifting mechanism 80 is not limited to the above configuration but may be any other configuration to lift up and lower the arm 60. Furthermore, the lifting mechanism 80 employs the lift cylinder 81-based driving system in this illustrated example but may employ a motor driving system via a ball screw or a belt mechanism.

The base end portion 60*b* of the arm 60 is also connected with the turning mechanism 90 configured to turn the arm 60 via the frame 85. In this illustrated example, the turning mechanism 90 has a motor 93 that is connected with, for example, a lower end of a shaft 92 fixed to a lower portion of the frame 85 as shown in FIG. 4. The motor 93 is connected with the shaft 92 via, for example, a reduction mechanism or the like. An axis of the motor 93 may be directly connected with the shaft 92. The arm 60 is configured to be turnable in a plane parallel to the polishing surface 102 via the shaft 92 that is rotated by rotation of the motor 93. The turning mechanism 90 is not limited to the configuration described above but may employ any other configuration that enables the arm 60 to be turned. For example, a pulse motor may be used for the motor 93 of the turning mechanism 90, and the arm 60 may be turned to any angle by regulating the input pulse of the pulse motor.

In this illustrated example, as shown in FIG. 2 and FIG. 3, the base end portion 60*b* of the metal arm 60 and the lifting mechanism 80 are placed in a waterproof box 71 provided to protect these components from splashes of the slurry, water, polishing residue and the like. As shown in FIG. 2 and FIG. 3, the base end side of the arm 60 is covered with a waterproof box 72. For the purpose of enhancing the waterproof performance of the arm 60, the surface of the arm 60 (especially, a portion of the arm 60 located outside of the waterproof boxes 71 and 72 in FIG. 2 and FIG. 3) may be coated with a water-repellent material such as a fluororesin. In this case, appropriately cleaning the portion of the arm 60 located outside of the waterproof boxes 71 and 72 by using the cleaning nozzle 300 (shown in FIG. 1) outside of the polishing table 20 reduces a trouble caused by adhesion of the slurry and the like. A configuration of covering a major part or the entirety of the arm 60 with a waterproof cover may be employed in place of the configuration of coating the arm 60 with the resin. The waterproof boxes 71 and 72 may also be appropriately cleaned by using the cleaning nozzle 300 (shown in FIG. 1).

(Suspending Mechanism)

Figure 5:
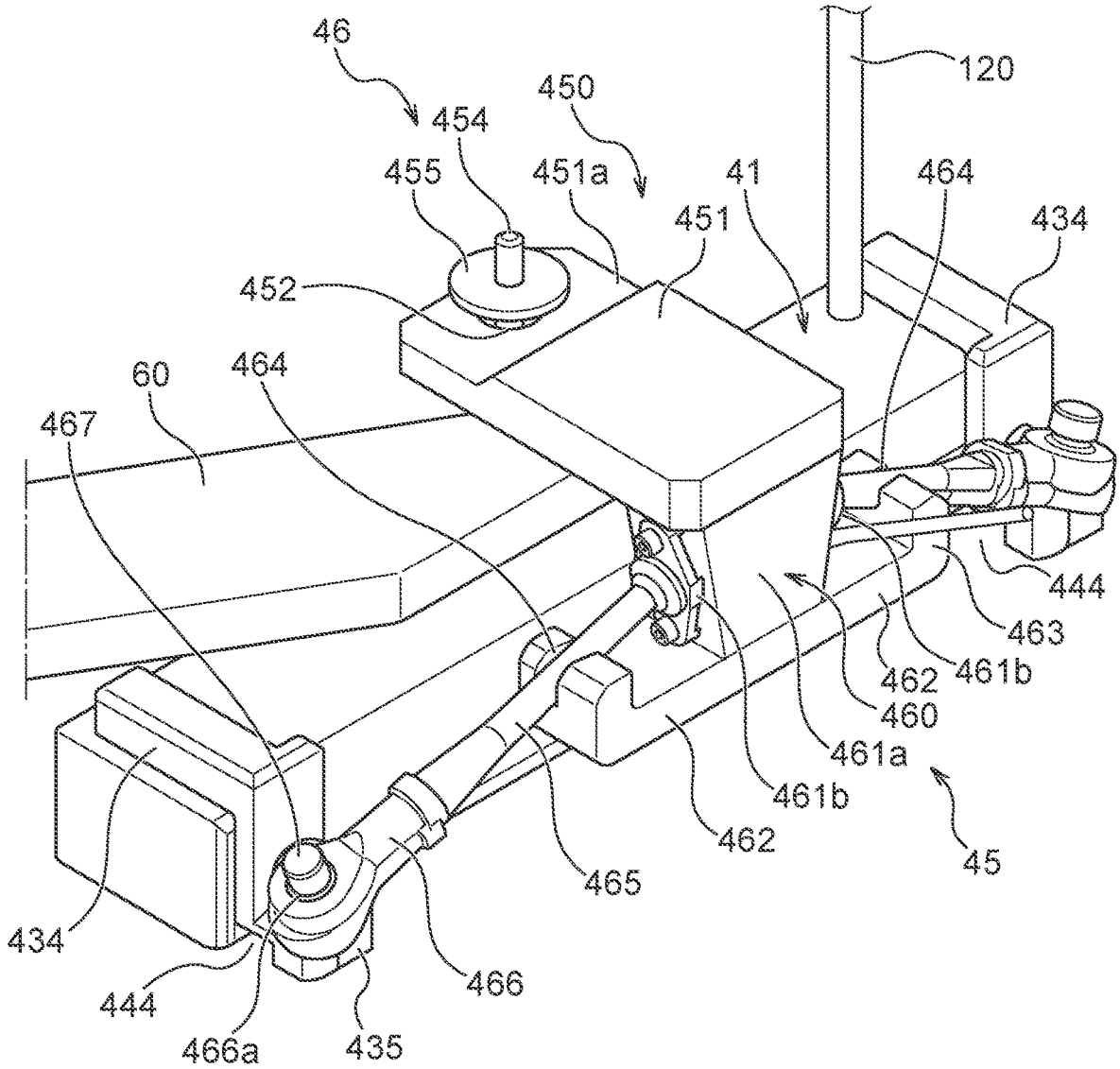
FIG. 5 is a perspective view illustrating a polishing solution supply device.
Figure 6:
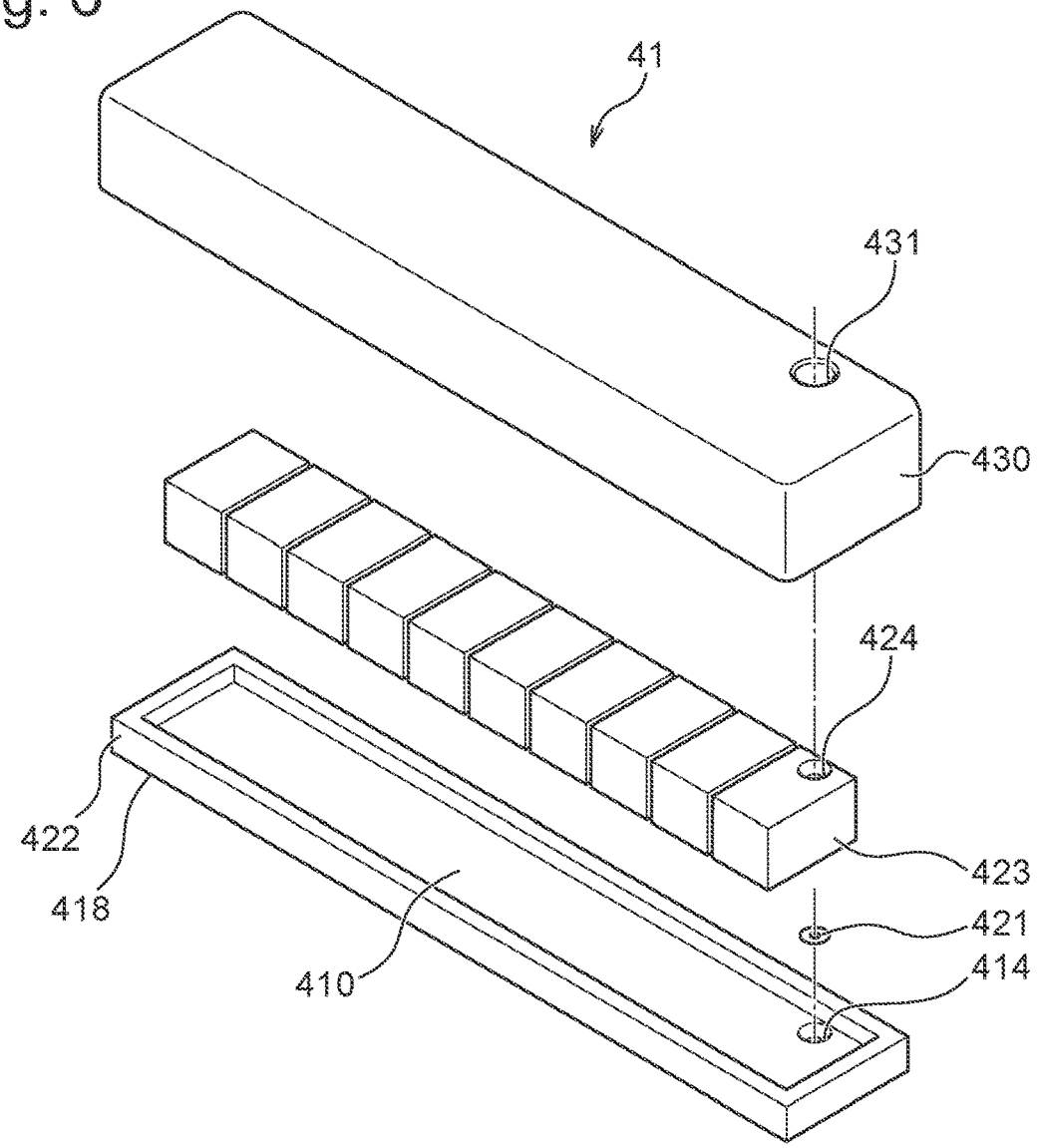
FIG. 6 is an exploded perspective view illustrating the polishing solution supply device.

FIG. 5 is a perspective view illustrating the polishing solution supply device. As shown in FIG. 2 and FIG. 5, the suspending mechanism 46 includes an arm-side stopper 450 (corresponding to the "engagement portion") fixed to a leading end of the arm 60 and a pad-side stopper 455 (corresponding to the "first stopper") fixed to the polishing solution supply device 41 via a shaft 454. The arm-side stopper 450 may be fixed to the arm 60 by a bolt, by an adhesive or by any other means. The arm-side stopper 450 may be formed integrally with the arm 60 (i.e., part of the arm 60 may form the arm-side stopper 450). The shaft 454 has one end fixed to a cover 430 of the polishing solution supply device 41 (as shown in FIG. 6) and is provided with the pad-side stopper 455 on the other end thereof. The pad-side stopper 455 employed may be, for example, a washer or a flange but may be any structure that serves as a large diameter portion of the shaft 454. The pad-side stopper 455 may be fixed to the shaft 454 by nut insertion, by an adhesive or by any other means and may be formed integrally with the shaft 454. The shaft 454 is passed through a through hole 452 provided in the arm-side stopper 450 between the polishing solution supply device 41 and the pad-side stopper 455. The through hole 452 has a passage area of such dimensions that do not cause an inner wall thereof to come into contact with the shaft 454 and is configured to prevent the shaft 454 from coming into contact with a passage wall (inner wall) thereof during operation of the following mechanism 45. The through hole 452 is a circular hole in this illustrated example but may be a hole or a cut in any arbitrary shape (including a polygonal shape or the like). In the case of a cut, the polishing solution supply device 41 may be demounted from the arm-side stopper 450 without detachment of the pad-side stopper 455 from the shaft 454.

When the arm 60 is lifted up by the lifting mechanism 80, the arm-side stopper 450 is engaged with a lower face of the pad-side stopper 455 (more specifically, the pad-side stopper 455 is engaged with a peripheral part of the through hole 452 of the arm-side stopper 450), and the polishing solution supply device 41 is lifted up with the lift-up of the arm 60. In this state, the pad-side stopper 455 serves to suppress inclination of the polishing solution supply device 41 in a width direction/short side direction (a direction crossing a longitudinal direction). When the arm 60 is lowered in the state that the polishing solution supply device 41 is landed on the polishing surface 102, the arm-side stopper 450 is separated from the lower face of the pad-side stopper 455 and moves downward. In this state, the polishing solution supply device 41 is released from the hold/support of the arm 60 and is brought into contact with the polishing surface 102 uniformly (to follow the unevenness of the polishing surface 102) by the load of a weight 423 (described later) provided inside thereof, irrespective of the position of the arm 60. In this illustrated example, an upper face 451 of the arm-side stopper 450 has a stepped face 451*a* (hereinafter also referred to as stopper face 451*a*) that is a part where the arm-side stopper 450 is engaged with the pad-side stopper 455 and that is lower than a residual part. The height of the stepped face 451*a* is set by adjusting the position of engagement of the pad-side stopper 455 with the arm-side stopper 450. According to a modification, the upper face 451 may be a flat face without formation of the stepped face 451*a*. The position of engagement of the pad-side stopper 455 with the arm-side stopper 450 may be adjusted by adjusting the position of the pad-side stopper 455 relative to the polishing solution supply device 41 (shaft 454) with omission of the stepped face 451*a* or in combination with the stepped face 451*a*. According to another modification, in place of or in combination with these adjusting methods, a shim (not shown) may be placed between the arm 60 and the arm-side stopper 450, and the position of engagement of the arm-side stopper 450 with the pad-side stopper 455 may be adjusted by changing the height of the shim.

(Following Mechanism)

As shown in FIG. 3 and FIG. 5, the following mechanism 45 includes a housing-type spherical joint assembly 460 fixed to the arm-side stopper 450, retainer-stoppers 463 (corresponding to the "second stoppers") provided on respective sides of the spherical joint assembly 460, and rods 465 provided on the respective sides of the spherical joint assembly 460 to connect the spherical joint assembly 460 with the polishing solution supply device 41 such as to allow for relative motions thereof. According to the embodiment, the spherical joint assembly 460 (more specifically, spherical joints 461*b*) is placed between the respective rods 465 and is fixed to the arm 60 via the arm-side stopper 450. According to the embodiment, the spherical joint assembly 460 is placed at the center in the longitudinal direction of the polishing solution supply device 41 (more specifically, the spherical joints 461*b* are placed in the vicinity of the center in the longitudinal direction and at positions symmetric with respect to the center). The respective rods 465 have an identical length and are configured to be movable in a plane approximately perpendicular to the polishing surface 102. This configuration enables the respective rods 465 to be symmetrically arranged and to slide symmetrically in the longitudinal direction of the polishing solution supply device 41 and suppresses inclination of the polishing solution supply device 41 in the longitudinal direction. According to another embodiment, the respective rods 465 may be configured to be movable in a plane different from the plane approximately perpendicular to the polishing surface 102. According to another embodiment, the respective rods 465 may be configured to have different lengths. The spherical joint assembly 460 and/or the retainer-stoppers 463 may be divided corresponding to the respective rods 465. For example, each of the spherical joints 461*b* may be provided in an individual plate-like member fixed to the arm 60 via the arm-side stopper 450, in place of a housing 461*a*. The arm-side stopper 450, the spherical joint assembly 460, and the retainer-stoppers 463 may be formed as separate members and may be fixed to each other by any means such as screwing or adhesion. Part or the entirety of the arm-side stopper 450, the spherical joint assembly 460, and the retainer-stoppers 463 may be formed integrally.

The following mechanism 45 provides a structure serving to enable a bottom face of a contact member 410 of the polishing solution supply device 41 (shown in FIG. 6) to follow a time change in unevenness of the polishing pad 100 that is in contact with the contact member 410 (including a time change in unevenness caused by rotation of the polishing pad and a time change in unevenness caused by abrasion), while keeping the entire bottom face of the contact member 410 horizontal (i.e., while keeping the bottom face horizontal as a whole). In the illustrated example of FIG. 3 and FIG. 5, the spherical joint assembly 460 is fixed to the arm-side stopper 450 on an upstream side in rotation of the polishing table 20. When the polishing solution supply member 41 is in contact with the polishing pad 100, a rotational moment is applied to the polishing solution supply member 41 by friction against the polishing pad 100. The polishing solution supply member 41 is thus likely to be inclined about its upstream side end in rotation as the supporting point. Placing the spherical joint assembly 460 at this position of the supporting point suppresses inclination of the polishing solution supply device 41.

The spherical joint assembly 460 includes the housing 461*a* and the spherical joints 461*b* mounted to respective side faces of the housing 461*a* by screwing or by any other fixing means. The spherical joint 461*b* includes a spherical body having a bearing (through hole) which a shaft passes through, and a main body configured to hold the spherical body in a rotatable manner. This configuration enables the shaft (rod 465) to be slidable through the spherical joint 461*b* with changing the inclination of the shaft. The housing 461*a* has inner spaces provided to receive respective one ends of the respective rods 465 (in this example, also called leading ends/second ends). The respective inner spaces provided to receive the respective rods 465 may be formed separately from each other or may be formed to communicate with each other. The one end of each rod 465 is passed through the bearing of the spherical joint 461*b* to be inserted into the inner space of the housing 461*a* and is arranged to be slidable in the bearing of the spherical joint 461*b*. This configuration enables each rod 465 to be slid by the spherical joint 461*b* with changing the angle to the polishing surface 102, when the spherical joint assembly 460 is lifted up or lowered relative to the polishing solution supply device 41. Each rod 465 can thus follow the vertical motions of the arm 60.

The other end of the rod 465 (in this example, also called a base end/a first end) is connected with a rod end 466 having a spherical joint 466*a* (shown in FIG. 5) by screwing, by pressure clamping or the like. The rod end 466 includes a cylindrical portion having one end connected with the rod 465 and a substantially flat mounting portion provided on the other end of the cylindrical portion. This mounting portion is provided with a spherical joint 466*a*. A spherical body having a bearing (through hole) which a shaft (a shaft 467 in this example) passes through is mounted in a rotatable manner to the spherical joint 466*a*. The shaft 467 is passed through the bearing of the spherical joint 466*a* of the rod end 466 and is fixed to a mounting surface of a mounting portion 435 of a bracket 434. This configuration causes the rods 465 to be fixed to the polishing solution supply device 41 via the spherical joints 466*a*. The respective mounting surfaces of the mounting portions 435 are inclined to rise from outside toward inside in the longitudinal direction of the polishing solution supply device 41. The brackets 434 are fixed to the cover 430 of the polishing solution supply device 41 by screwing, by adhesion or by any other fixing means. A washer may be placed between the rod end 466 and the mounting surface of the mounting portion 435 of the bracket 434, in order to suppress backlash of the spherical joint 461*b*. The rod end 466 is configured to change the inclination to the polishing surface 102 by the spherical joint 466*a* in the course of lifting up or lowering the spherical joint assembly 460. Changing the inclination of the rod end 466 changes the inclination of the rod 465. When the spherical joint assembly 460 is lifted up or lowered, the respective rods 465 slide the spherical joints 461*b* by their leading end sides, with changing their inclinations by the spherical joints 461*b* and 466*a* placed on the respective ends of the rods 465. This causes the respective rods 465 to follow the motion of the spherical joint assembly 460 (the arm 60) in the vertical direction. It may be regarded that the rod 465 and the rod end 466 collectively form a rod and that the rod has the rod end 466.

The retainer-stoppers 463 are provided via arms 462 extended to respective sides in the longitudinal direction of the polishing solution supply device 41 in a lower portion of the spherical joint assembly 460. The retainer-stopper 463 has a groove 464 provided to receive a middle portion of each rod 465 (a portion between the rod end 466 and the spherical joint 461*b*). The retainer-stopper 463 has side walls on the respective sides of the groove 464 to suppress/prevent each rod 465 from moving in a lateral direction (falling down toward the polishing solution supply device 41-side or toward its opposite side). The groove 464 has a bottom face configured to support each rod 465 upward. This configuration causes the respective rods 465 to be engaged with the retainer-stoppers 463 at positions of an identical height symmetric with respect to the spherical joint assembly 460 and thereby suppresses/prevents inclination of the polishing solution supply device 41 in a width direction. The retainer-stoppers 463 (the grooves 464) are configured to receive the load of the polishing solution supply device 41, when the polishing solution supply device 41 is lifted up by the arm 60.

The rod ends 466 of the respective rods 465 are fixed to a lower portion (vicinity of a bottom face) of the polishing solution supply device 41, and/or the arm 60 (the following mechanism 45) is arranged such as to pull the polishing solution supply device 41 relative to the rotating direction of the polishing table 20. This configuration reduces the influence of bending moment on the polishing solution supply device 41 caused by a friction torque generated by rotation of the polishing table 20.

As shown in FIG. 5, the polishing solution supply device 41 is fixed to the arm 60 via the spherical joint assembly 460, the rods 465 and the rod ends 466 to have its inclination changeable and is placed on a downstream side of the fixing location with the arm 60. In other words, the arm 60 supports the polishing solution supply device 41 such as to pull the polishing solution supply device 41 relative to the flow (the rotating direction of the polishing pad 100). This configuration reduces the influence of bending moment on the polishing solution supply device 41 caused by rotation of the polishing table 20. Furthermore, the arm 60 supports the polishing solution supply device 41 such as to pull the polishing solution supply device 41 relative to the flow (the rotating direction of the polishing pad 100). This configuration reduces the vibration caused by thrust of the polishing solution supply device 41 into the arm 60 by the rotation of the polishing pad 100 (the polishing table 20).

When the spherical joint assembly 460 is lifted up with a lift-up motion of the arm 60, the respective rods 465 slide the spherical joint assembly 460 (the spherical joints 461*b*) by their leading end sides, while changing their angles to come close to a direction vertical to the polishing surface 102. When the spherical joint assembly 460 is lowered with a lowering motion of the arm 60, the respective rods 465 slide the spherical joint assembly 460 (the spherical joints 461*b*) by their leading end sides, while changing their angles to come close to a direction horizontal to the polishing surface 102. In such states, the middle portions of the respective rods 465 are supported in the grooves 464 of the retainer-stoppers 463 and change their angles to the polishing surface 102. This suppresses/prevents the inclination of the polishing solution supply device 41 in the width direction. When the arm 60 is lifted up and the arm-side stopper 450 (the stepped face 451*a*) is engaged with the pad-side stopper 455, this fixes the distances between the polishing solution supply device 41 and the arm-side stopper 450 and also fixes the positions of the spherical joint assembly 460 and the retainer-stoppers 463 relative to the polishing solution supply device 41. Furthermore, fixing the distance between the polishing solution supply device 41 and the arm-side stopper 450 fixes the positions of the respective rods 465 as well as the positions of the spherical joint assembly 460 and the retainer-stoppers 463 relative to the polishing solution supply device 41. When the arm 60 is further lifted up, the polishing solution supply device 41 is lifted up together with the arm 60 in the state that the pad-side stopper 455 is locked by the arm-side stopper 450 (the stepped face 451*a*) and that the respective rods 465 are locked by the retainer-stoppers 463. In this state, the polishing solution supply device 41 is locked simultaneously by the pad-side stopper 455 and the two retainer-stoppers 463 and is thus lifted up in a stable attitude. Additionally, the retainer-stoppers 463 serve to fix the respective rods 465 and to suppress/prevent the inclination of the polishing solution supply device 41 in the width direction. This further enables the polishing solution supply device 41 to be lifted up in a stable attitude. When the pad-side stopper 455 is released from the arm-side stopper 450, on the contrary, the weights placed inside of the polishing solution supply device 41 cause the polishing solution supply device 41 to come into contact with the polishing surface 102 evenly (to follow the unevenness of the polishing surface 102). The respective rods 465 slide along with the move of the polishing solution supply device 41 and thereby enable the polishing solution supply device 41 to follow the unevenness of the polishing surface 102 while maintaining the horizontal attitude.

(Polishing Solution Supply Device)

Figure 7:
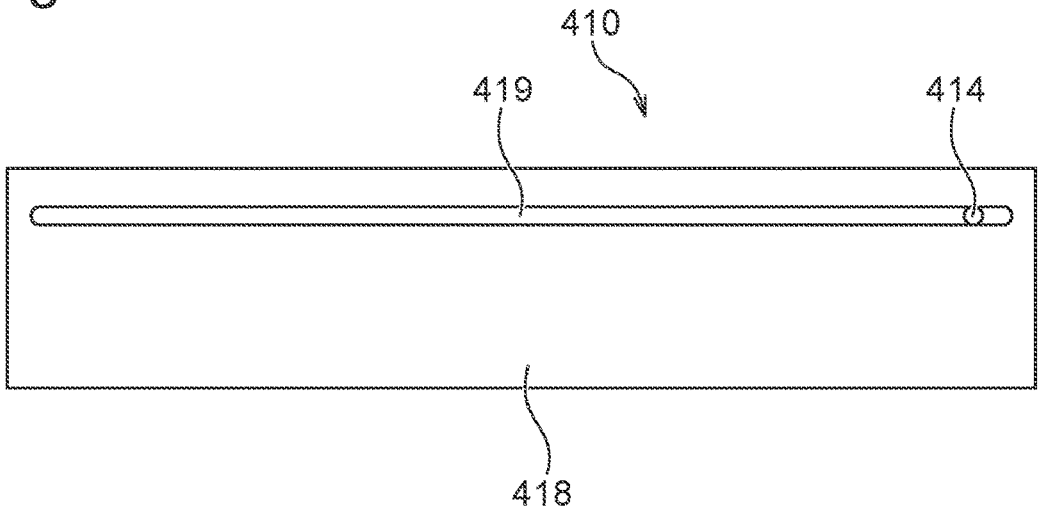
FIG. 7 is a perspective view illustrating a contact member of the polishing solution supply device viewed from a bottom face side thereof.

FIG. 6 is an exploded perspective view illustrating the polishing solution supply device 41. FIG. 7 is a perspective view illustrating the contact member 410 of the polishing solution supply device 41 viewed from its bottom face side.

As shown in FIG. 6, the polishing solution supply device 41 includes the contact member 410, a plurality of weights 423, the cover 430, and a packing 422. The contact member 410 and the cover 430 are made of a resin. The contact member 410 is made of, for example, a rigid plastic such as PPS or PEEK. The contact member 410 is formed, for example, as a plate-like member. As shown in FIG. 7, a slit 419 serving as an opening is formed in a bottom face 418 of the contact member 410 to supply the slurry onto the polishing surface 102. The slit 419 is provided with a supply port 414 formed on a bottom face thereof to supply the slurry into the slit 419. The slurry supplied from the supply port 414 is spread in the slit 419 and is further pressed and spread through a clearance between the bottom face 418 of the contact member 410 and the polishing pad 100 onto the polishing pad 100. Any number of the supply ports 414 may be provided in the slit 419 at any positions in a slit longitudinal direction according to the specification of the apparatus and the like. As shown in FIG. 6, the supply port 414 is extended to an upper face of the contact member 410 to be open to the upper face. The supply port 414 is chamfered on the upper face side of the contact member 410 to receive the slurry supply line 120 such as a tube (shown in FIG. 5) and/or an O-ring 421. Any seal other than the O-ring 421 may be employed for the purpose of sealing. In the example of FIG. 7, the shape of the contact member 410 is not limited to a rectangular shape but may be any shape having long and short lengths in two different directions (for example, two directions orthogonal to each other). For example, the contact member 410 may be formed in a polygonal shape other than the rectangular shape (for example, a triangular shape or a pentagonal shape) or in a shape at least partly having a curve. The slit 419 may have an opening end on both or one of the respective ends in the longitudinal direction (i.e., the slit 419 may be extended to short sides of the polishing solution supply device 41 to be open to the short sides in FIG. 7). The contact member 410 may have a groove other than the slurry supply port 414 and the slit 419. The opening is not limited to the slit or the groove but may be configured by a plurality of holes arrayed in one line or in multiple lines.

The respective weights 423 may be mounted to the contact member 410 by screwing, by adhesion, by welding or by any other fixing means. Each of the weights 423 and the contact member 410 may be provided with a structure for positioning (for example, a pin and a pin hole). The cover 430 may be mounted to the contact member 410 by screwing, by adhesion, by welding or by any other fixing means. The cover 430 is mounted to the contact member 410 such as to cover the weights 423 placed on the contact member 410.

The material used for the weights 423 may be a metal material such as SUS, and the surface of the weights 423 may be coated with a fluororesin or the like. In this illustrated example, the weights 423 are mounted to the contact member 410 directly without using any other layer. An adhesive layer or an elastic layer may be placed between the contact member 410 and the weights 423 according to the fixation technique employed. The weight 423 placed on one end is provided with a through hole 424 that penetrates from an upper face to a lower face thereof, and the slurry supply line 120 such as a tube (shown in FIG. 5) is inserted into the through hole 424. The slurry supply line 120 is passed through the through hole 424 of the weight 423 and is inserted through the O-ring 421 into the supply port 414 of the contact member 410. Tightly fixing the weights 423 to the contact member 410 in this state crushes the O-ring 421 to seal the connecting location of the slurry supply line with the supply port 414 and to enhance the air tightness. The slurry supply line 120 is also passed through the through hole 431 of the cover 430.

The cover 430 is mounted to cover the contact member 410 and the plurality of weights 423. The packing 422 is placed on the contact member 410 to surround the weights 423 on the contact member 410. The packing 422 is mounted to the circumference of an upper face of the contact member 410 by, for example, a double-sided tape. The fixation of the packing 422 is not limited to using the double-sided tape but may be performed by adhesion or by any other fixing means. The packing 422 may be made of a soft resin (for example, PTFE), a rubber (for example, EPDM) or the like. In the course of mounting the cover 430 to the contact member 410, an upper face of the packing 422 is brought into contact with a shoulder portion (not shown) provided in an inner wall of the cover 430 to be crushed by a predetermined thickness. This enhances the air tightness by the cover 430. As a result, the packing 422 seals between the cover 430 and the contact member 410 and suppresses/prevents the slurry, the polishing residue and the like from entering inside of the cover 430.

As shown in FIG. 5, the polishing solution supply device 41 further includes the two brackets 434 mounted to the respective ends of the cover 430 in the longitudinal direction. At least one of the brackets 434 may be formed integrally with the cover 430. Each of the bracket 434 has an approximately L shape and is mounted to an upper face and an upstream side face of the cover 430. The mounting portion 435 is integrally provided with a lower portion of a part of the bracket 434 placed on the upstream side face of the cover 430 and is configured to mount the rod end 466 of the following mechanism 45. A passage 444 is provided on a lower face of the mounting portion 435 to discharge the used slurry that hits against the upstream side face of the cover 430. The passage 444 is formed to pass through the mounting portion 435 along a longitudinal direction of the cover 430. A mounting surface is provided on an upper face of the mounting portion 435 to mount the rod end 466. The mounting surface of the mounting portion 435 is formed as an inclined plane sloping down from inside toward outside in the longitudinal direction of the cover 430. The mounting surface of the mounting portion 435 has a fitting hole or a threaded hole to fix a leading end of the shaft 467 for mounting the rod end 466. The mounting surface of the mounting portion 435 placed nearer to the polishing surface 102 more effectively suppresses the inclination and the vibration of the polishing solution supply device 41 caused by a friction torque during polishing.

(Description of Suspending/Following Operations)

Figure 8A:
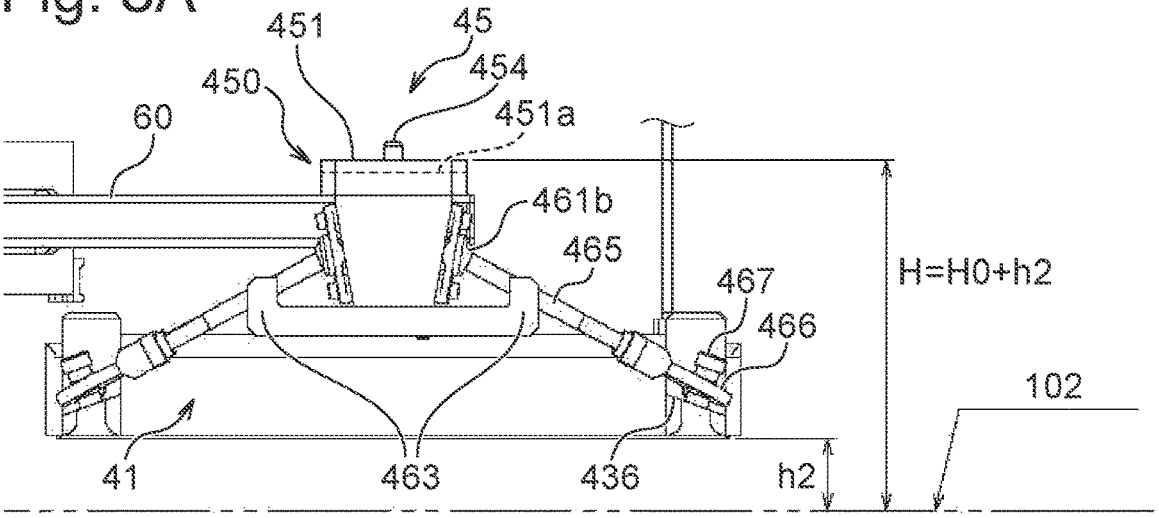
FIG. 8A is a diagram illustrating the operations of a following mechanism and a suspending mechanism viewed from an upstream side thereof.
Figure 8B:
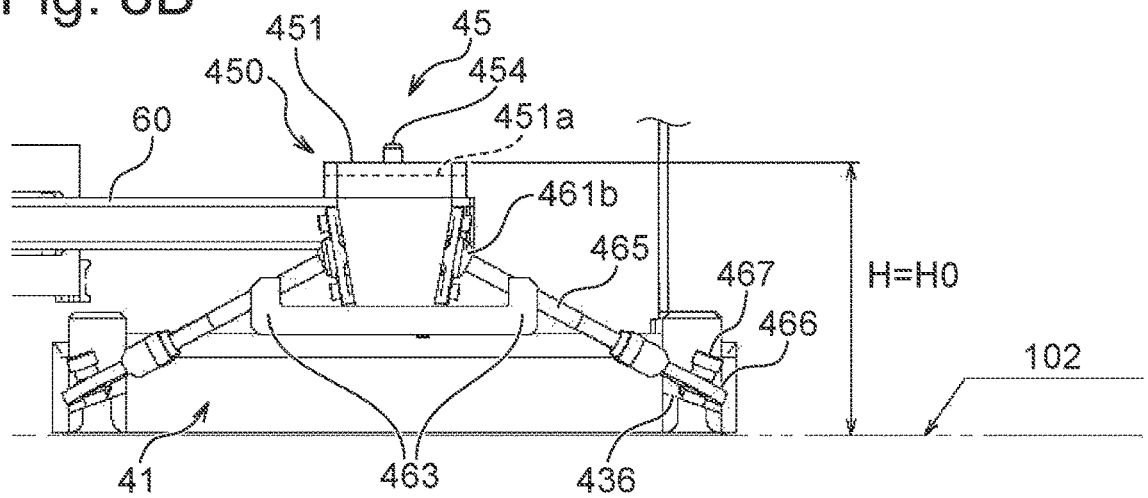
FIG. 8B is a diagram illustrating the operations of the following mechanism and the suspending mechanism viewed from the upstream side thereof.
Figure 8C:
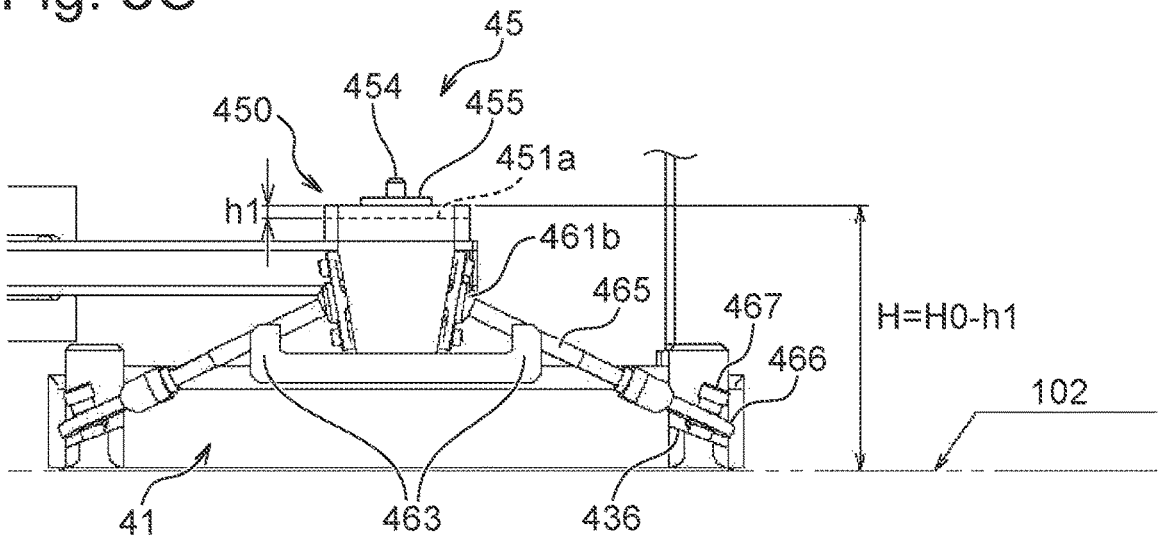
FIG. 8C is a diagram illustrating the operations of the following mechanism and the suspending mechanism viewed from the upstream side thereof.

FIGS. 8A to 8C and FIGS. 9A to 9C are diagrams illustrating the operations of the following mechanism and the suspending mechanism. FIGS. 8A to 8C are side views illustrating the vicinity of the polishing solution supply device 41 from an upstream side (slurry discharge side).

Figure 9A:
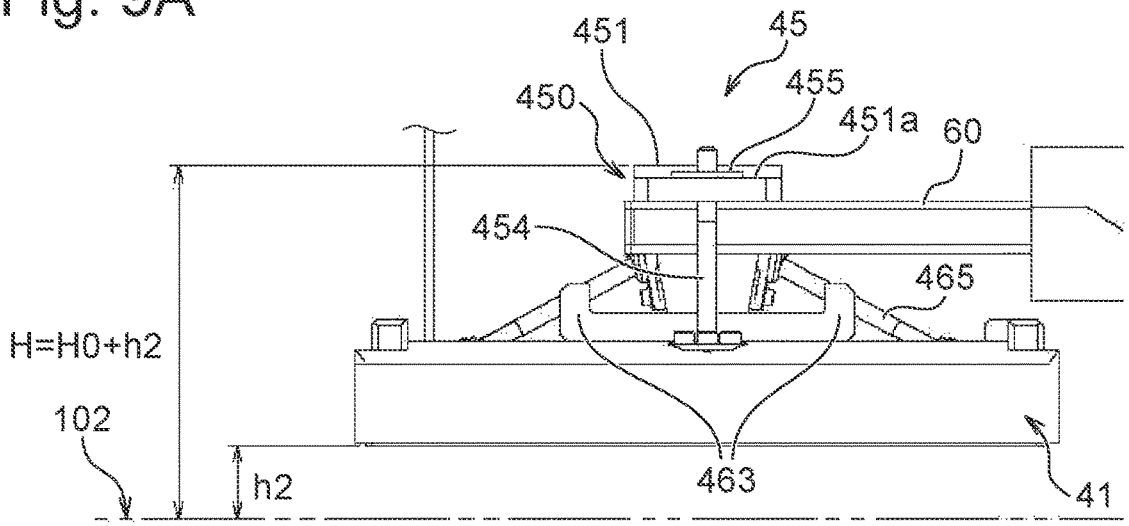
FIG. 9A is a diagram illustrating the operations of the following mechanism and the suspending mechanism viewed from a downstream side thereof.
Figure 9B:
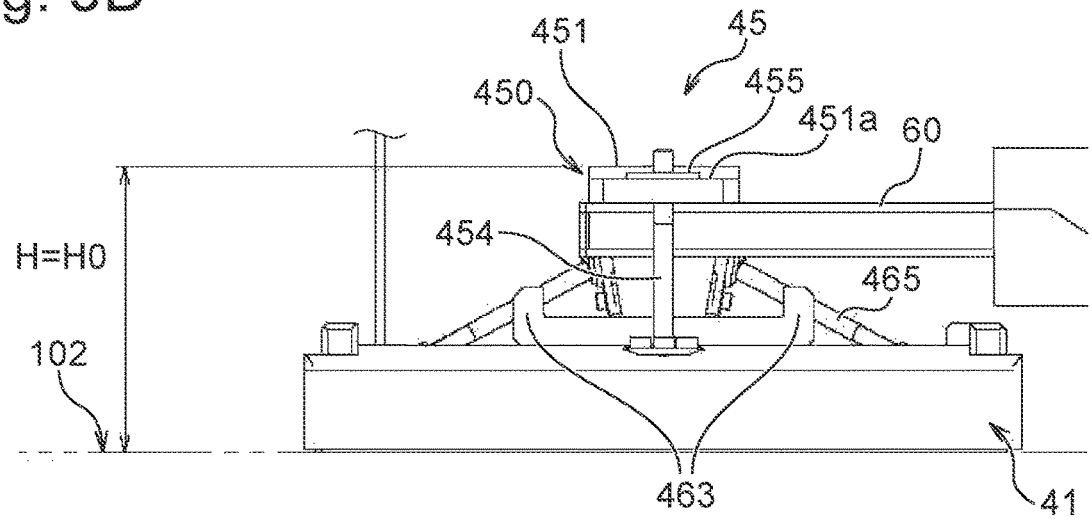
FIG. 9B is a diagram illustrating the operations of the following mechanism and the suspending mechanism viewed from the downstream side thereof.
Figure 9C:
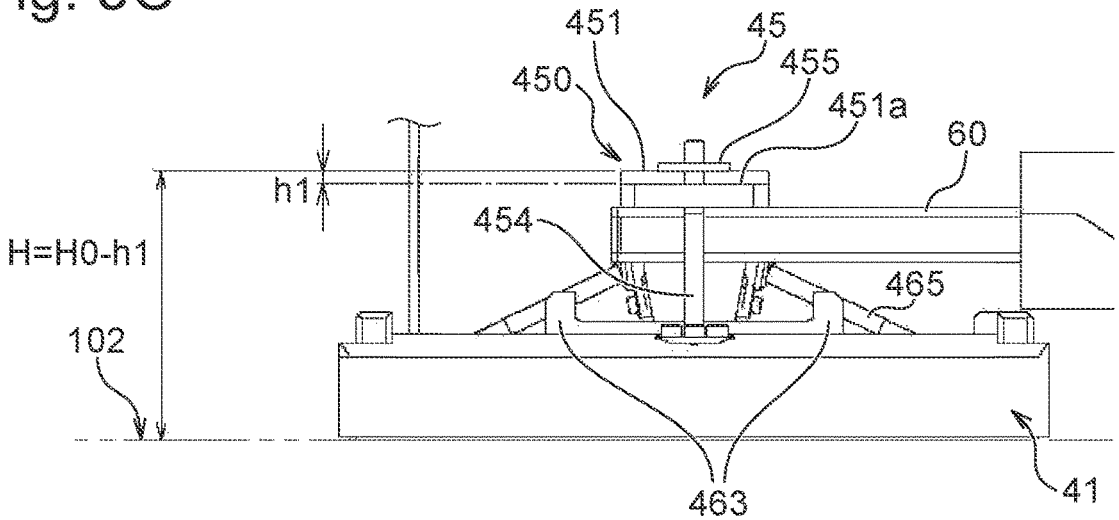
FIG. 9C is a diagram illustrating the operations of the following mechanism and the suspending mechanism viewed from the downstream side thereof.

FIGS. 9A to 9C are side views illustrating the vicinity of the polishing solution supply device 41 from a downstream side (slurry supply side).

FIG. 8A and FIG. 9A illustrate the state that the arm 60 and the following mechanism 45/the suspending mechanism 46 suspend the polishing solution supply device 41 at a height h2 (a height to the lower face of the polishing solution supply device 41 relative to the polishing surface 102 as a reference plane). In this state, the upper face 451 of the arm-side stopper 450 (i.e., the portion other than the stepped face 451*a*) has a height of H=H0+h2. At this time, the stepped face 451*a* of the arm-side stopper 450 is engaged with the pad-side stopper 455. The respective rods 465 are supported upward by the retainer-stoppers 463. This suppresses/prevents the inclination of the polishing solution supply device 41 in the width direction. The suspending mechanism 46 (the arm-side stopper 450 and the pad-side stopper 455) also serves to suppress/prevent the inclination of the polishing solution supply device 41 in the width direction.

FIG. 8B and FIG. 9B illustrate that state that arm 60 is lowered by the height h2 from the state of FIG. 8A and FIG. 9A and that the arm 60 and the following mechanism 45/the suspending mechanism 46 land the polishing solution supply device 41 on the polishing surface 102. At this time, the stepped face 451*a* of the arm-side stopper 450 is still engaged with the pad-side stopper 455. In this state, the polishing solution supply device 41 is held by the arm 60 and is not allowed to be further lowered independently of the position of the arm 60. In this state, the polishing solution supply device 41 has a height of 0, and the upper face 451 of the arm-side stopper 450 has a height of H=H0. The respective rods 465 are supported upward by the retainer-stoppers 463. This suppresses/prevents the inclination of the polishing solution supply device 41 in the width direction. The suspending mechanism 46 (the arm-side stopper 450 and the pad-side stopper 455) also serves to suppress/prevent the inclination of the polishing solution supply device 41 in the width direction.

FIG. 8C and FIG. 9C illustrate the state that the arm 60 is further lowered by a height h1 (<h2) from the state of FIG. 8B and FIG. 9B and that the polishing process is performed with supplying the slurry from the polishing solution supply device 41 onto the polishing surface 102. The upper face 451 of the arm-side stopper 450 has a height of H=H0-*h*1. In this state, the polishing solution supply device 41 lands on the polishing surface 102. Accordingly, while the height of the pad-side stopper 455 from the polishing surface 102 is not changed, only the arm-side stopper 450 (the stepped face 451*a*) is lowered to be separated from the pad-side stopper 455. In this state, the pad-side stopper 455 is released from the arm-side stopper 450 (the stepped face 451*a*), and the polishing solution supply device 41 is brought into contact with the polishing surface 102 by the load of the plurality of weights 423 in the state released from the arm 60 (independently of the position of the arm 60). This enables the contact member 410 to be bent corresponding to the unevenness of the polishing surface 102 by the plurality of weights 423 arrayed in the longitudinal direction of the polishing solution supply device 41.

In the event of abrasion of the polishing surface 102, the polishing solution supply device 41 and the pad-side stopper 455 follow the downward motion of the polishing surface 102 to be lowered from the state of FIGS. 8C and 9C, whereas the arm 60 and the arm-side stopper 450 (the stepped face 451*a*) are not lowered but are kept at the height. Accordingly, the pad-side stopper 455 tends to lower and become close to the stepped face 451*a* of the arm-side stopper 450. In this case, h1 (a distance by which the arm 60 is further lowered from the position where the polishing solution supply device 41 is landed (i.e., a distance by which the pad-side stopper 455 and the arm-side stopper 450 are separated from each other)) is to be set larger than an amount corresponding to the abrasion of the polishing surface 102. Even when the pad-side stopper 455 follows the abrasion of the polishing surface 102 to be lowered, this setting does not bring the pad-side stopper 455 into contact with the arm-side stopper 450 (the stepped face 451*a*) but keeps the polishing solution supply device 41 in the state released from the arm 60. This enables the bottom face 418 of the contact member 410 to follow the abrasion and the unevenness of the polishing surface 102 by the load of the weights 423 placed in the polishing solution supply device 41.

In this example, the stroke of the vertical motion of the arm 60 by the lifting mechanism 80 (the lift cylinder 81) is h1+h2. By this stroke, the lifting mechanism 80 lifts up the arm 60 and thereby lifts up the polishing solution supply device 41 from the polishing surface 102 to the height of h2 (as shown in FIG. 8A and FIG. 9A). The lifting mechanism 80 also lowers the arm 60 by the height h2 and thereby lands the polishing solution supply device 41 on the polishing surface 102 (as shown in FIG. 8B and FIG. 9B). The lifting mechanism 80 further lowers the arm 60 by the height h1 in the state that the polishing solution supply device 41 lands on the polishing surface 102, and thereby releases the polishing solution supply device 41 from the arm 60 (as shown in FIG. 8C and FIG. 9C).

The foregoing describes the series of operations to land the polishing solution supply device 41 on the polishing surface 102 and to release the polishing solution supply device 41 from the arm 60. The following describes the case where the polishing process is terminated and the polishing solution supply device 41 is retreated to outside of the polishing table 20. After the polishing process is terminated in the state of FIG. 8C and FIG. 9C, the arm 60 is lifted up. At this time, the stepped face 451*a* of the arm-side stopper 450 is separated from the pad-side stopper 455. Accordingly, until the stepped face 451*a* of the arm-side stopper 450 comes into contact with the pad-side stopper 455, neither the polishing solution supply device 41 nor the pad-side stopper 455 changes the height, while only the arm 60 and the stepped face 451*a* of the arm-side stopper 450 are lifted up. When the stepped face 451*a* of the arm-side stopper 450 is lifted up by the height of h1, the stepped face 451*a* comes into contact with the pad-side stopper 455. This is the state of FIG. 8B and FIG. 9B. When the arm 60 and the stepped face 451*a* of the arm-side stopper 450 are further lifted up from this state, the stepped face 451*a* of the arm-side stopper 450 is lifted up together with the pad-side stopper 455, and the polishing solution supply device 41 follows the upward motion of the arm 60 to be lifted up. The arm 60 is further lifted up by the height of h2 from the state of FIG. 8B and FIG. 9B to reach the state of FIG. 8A and FIG. 9A.

In the state of FIG. 8A and FIG. 9A, the arm 60 is turned by the turning mechanism 90 to refuge the polishing solution supply device 41 to the refuge position outside of the polishing table 20. At the refuge position outside of the polishing table 20, the polishing solution supply device 41 may be cleaned by using the cleaning nozzle 300 (shown in FIG. 1). This cleaning process cleans the bottom face of the contact member 410, the outer surface of the cover 430, and the arm 60. This washes away the slurry, the polishing residue and the like adhering to the polishing solution supply device 41. The polishing solution supply device 41 may be turned and moved by the arm 60 to be placed at a desired position on the polishing surface 102. This enables the position of the polishing solution supply device 41 to be readily adjusted on the polishing surface 102.

The configuration of the embodiment described above enables the polishing solution supply device 41 to be suspended and held by the following mechanism 45 and the suspending mechanism 46. This facilitates maintenance of the polishing solution supply device 41 and/or the polishing apparatus 1. More specifically, the configuration of the embodiment enables the weight pressure-type polishing solution supply device 41 to be suspended and held by the following mechanism 45 and the suspending mechanism 46. The configuration also cancels the suspension and enables the polishing solution supply device 41 to be brought into contact with the polishing surface 102 by the load of the weights 423. Furthermore, the polishing solution supply device 41 is suspended and held in the state that the two stoppers (the arm-side stopper 450 and the pad-side stopper 455, the retainer-stoppers 463 and the rods 465) are engaged with each other. This configuration enables the polishing solution supply device 41 to be lifted up and held in a stable attitude.

The configuration of the embodiment described above enables the weight pressure-type polishing solution supply device 41 to be retreated to the refuge position outside of the polishing table 20 and to be cleaned by using the cleaning nozzle 300. This configuration suppresses/prevents the slurry and the like adhering to the polishing solution supply device 41 from being fixed and dropping onto the polishing surface 102 to affect the polishing process. Moreover, this configuration enables the cleaning solution supply device 41 to be cleaned with suppressing/preventing the slurry, the polishing residue and the like washed away during the cleaning process from remaining on the polishing surface 102 of the polishing pad 100.

The configuration of the embodiment described above enables the polishing solution supply device 41 to be released from the vertical motions of the arm 60 by the following mechanism 45 and the suspending mechanism 46. This enables the polishing solution supply device 41 to supply the slurry to the polishing surface 102 in the state that the polishing solution supply device 41 is brought into contact with the polishing surface 102 by the load of the weights. Furthermore, the structure of the plurality of weights 423 enables the polishing solution supply device 41 to be flexibly bent along the longitudinal direction and to effectively follow the unevenness of the polishing surface 102 and/or the abrasion of the polishing surface 102.

The configuration of the embodiment described above enables the polishing solution supply device 41 to be moved between the supply position and the refuge position by turning the arm 60 in the state that the polishing solution supply device 41 is suspended by the following mechanism 45 and the suspending mechanism 46. This configuration also enables the position of the polishing solution supply device 41 to be readily adjusted on the polishing surface 102 by turning the polishing solution supply device 41. This configuration further enables the polishing solution supply device 41 kept landing on the polishing surface 102 to be swung during the polishing process or the like, so as to change the supply position of the slurry.

Furthermore, the retainer-stoppers 463 of the following mechanism 45 suppress/prevent the inclination of the polishing solution supply device 41 in the width direction. The location of fixation (the rod end 466) where the following mechanism 45 is mounted to the polishing solution supply device 41 is provided in the lower portion of the polishing solution supply device 41 (the vicinity of the bottom face). The arm 60 is arranged such as to pull the polishing solution supply device 41 relative to the rotating direction of the polishing pad (the polishing table). This configuration reduces the influence of bending moment on the polishing solution supply device 41 caused by the rotation of the polishing pad (the polishing table). Furthermore, this configuration enables the polishing solution supply device 41 to be suspended by the following mechanism 45 at the position of the low center of gravity and thereby stabilizes the attitude of the polishing solution supply device 41.

The configuration of the embodiment described above enables the suspending mechanism 46 and/or the following mechanism 45 to suppress the inclination of the polishing solution supply device 41 in the width direction and enables the bottom face of the polishing solution supply device 41 to be bent corresponding to the unevenness of the polishing surface 102 by means of the plurality of weights 423. The combination of such functions and advantageous effects enables the polishing solution supply device 41 to effectively follow the unevenness of the polishing surface 102 and effectively suppresses/prevents the non-uniform contact state. As a result, this ensures the stable supply of the slurry and stabilizes the polishing performance. Moreover, as described above, this configuration reduces the vibration of the polishing solution supply device 41 and thereby more effectively suppresses/prevents the non-uniform contact state. This further ensures the stable supply of the slurry and stabilizes the polishing performance.

(Other Embodiments)

(1) According to the embodiment described above, the cover 430 is used to cover the contact member 410 of the polishing solution supply device 41 and the packing 422 is provided for the purpose of waterproof effect. According to a modification, however, in place of providing the packing 422 or in addition to providing the packing 422, a line may be connected to feed a gas into an internal space of the cover 430 and purge the internal space of the cover 430 with the gas (an inert gas such as nitrogen gas). This modified configuration also suppresses/prevents the slurry from adhering to the upper portion of the contact member 410 and/or the weights 423. According to another modification, the cover 430 and the packing 422 may be omitted, and the contact member 410 and the weights 423 may be appropriately cleaned by using the cleaning nozzle 300. In this modification, the contact member 410 and the weights 423 are not covered by the cover 430 and can thus be readily cleaned. According to the embodiment described above, coating the surface of the weights with a fluororesin or the like further facilitates cleaning.

(2) The above embodiment describes the configuration that the weights 423 are placed inside of the polishing solution supply device 41. According to a modification, the polishing process may be performed with placing weights on the polishing solution supply device 41 that is located on the polishing surface 102 and that is released from the vertical motions of the arm 60, by a robot hand or the like, and the polishing solution supply device 41 may be suspended after removal of the weights. According to another modification, an airbag may be provided on the polishing solution supply device 41, and the polishing solution supply device 41 released from the vertical motions of the arm 60 may be uniformly brought into contact with the polishing surface 102 (to follow the unevenness of the polishing surface 102) by expansion of the airbag.

<Second Embodiment>

Figure 10A:
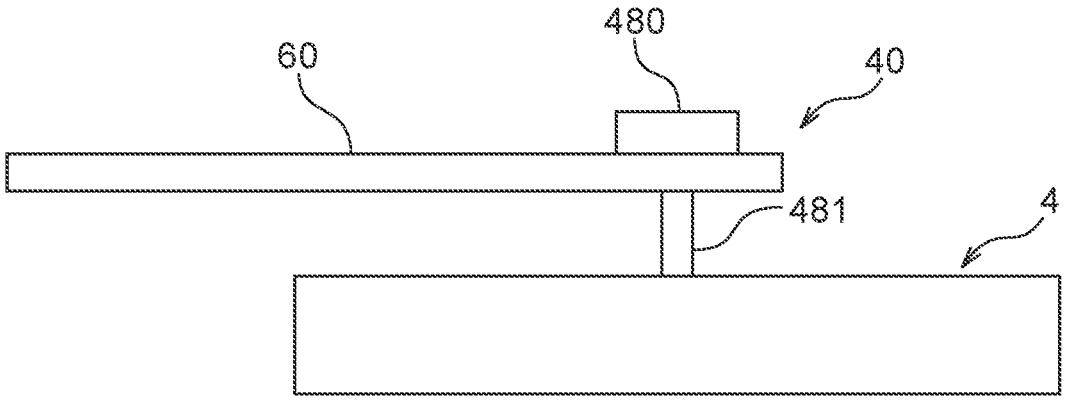
FIG. 10A is a schematic side view illustrating a polishing solution supply system according to a second embodiment.
Figure 10B:
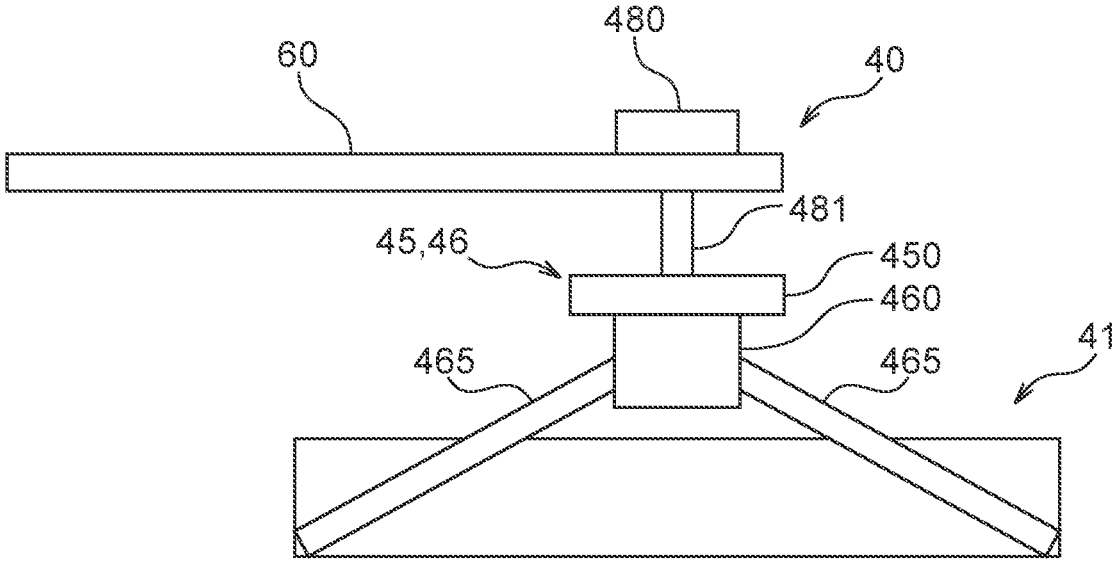
FIG. 10B is a schematic side view illustrating a polishing solution supply system in the case where the configuration of the second embodiment is applied to the polishing solution supply system of the first embodiment.

FIG. 10A is a schematic side view illustrating a polishing solution supply system according to a second embodiment. FIG. 10B is a schematic side view illustrating a polishing solution supply system in the case where the configuration of the second embodiment is applied to the polishing solution supply system of the first embodiment. The illustrations of these drawings are simplified by omitting the configuration of some part of the polishing solution supply system 40.

According to the second embodiment, the polishing apparatus 1 is provided with a rotating mechanism configured to rotate a polishing solution supply device 4 with respect to an arm 60. As shown in FIG. 10A, a polishing solution supply system 40 includes a motor 480 that is fixed to the arm 60 and serves as the rotating mechanism and the polishing solution supply device 4 fixed to a rotating shaft 481 of the motor 480. The polishing solution supply device 4 fixed to the rotating shaft 481 is configured to be rotated with respect to the arm 60 by the rotation of the motor 480, so as to change the angle of the polishing solution supply device 4 with respect to the arm 60 (angle relative to arm). Accordingly, the polishing solution supply device 4 is configured to change the angle and/or the position of the polishing solution supply device 4 on the polishing pad 100 by the rotation of the arm 60 by means of the turning mechanism 90 and/or by the rotation of the polishing solution supply device 4 with respect to the arm 60 by means of the motor 480. The rotation of the arm 60 and the rotation of the polishing solution supply device 4 or 41 are controlled by the controller 200.

The polishing solution supply device 4 may be a polishing solution supply device having any configuration such as to be in contact with an upper face of the polishing pad 100 or to be adjacent to the upper face of the polishing pad 100 across a small gap.

In the case of changing the angle and/or the position of the polishing solution supply device 4, the angle of the polishing solution supply device 4 may be changed after the polishing solution supply device 4 is lifted up/separated from the polishing pad 100. Alternatively, the angle of the polishing solution supply device 4 may be changed in such a state that the polishing solution supply device 4 is in contact with the polishing pad 100.

In the case where the configuration of the second embodiment is applied to the polishing solution supply system 40 of the first embodiment, as shown in FIG. 10B, a rotating shaft 481 of a motor 480 is mounted to the polishing solution supply device 41 via the following mechanism 45 and the suspending mechanism 46. For example, the rotating shaft 481 of the motor 480 is firmly fixed to the arm-side stopper 450 of the suspending mechanism 46. In other words, the arm-side stopper 450 is not directly fixed to the arm 60 but is fixed to the rotating shaft 481 of the motor 480 fixed to the arm 60 as shown in FIG. 10B. The polishing solution supply device 41 is rotated along with the following mechanism 45 and the suspending mechanism 46 with respect to the arm 60 by the rotation of the motor 480, so as to change the angle of the polishing solution supply device 41 with respect to the arm 60. Accordingly, the polishing solution supply device 41 is configured to change the angle and/or the position of the polishing solution supply device 41 on the polishing pad 100 by the rotation of the arm 60 by means of the turning mechanism 90 and/or by the rotation of the polishing solution supply device 41 with respect to the arm 60 by means of the motor 480.

Figure 11:
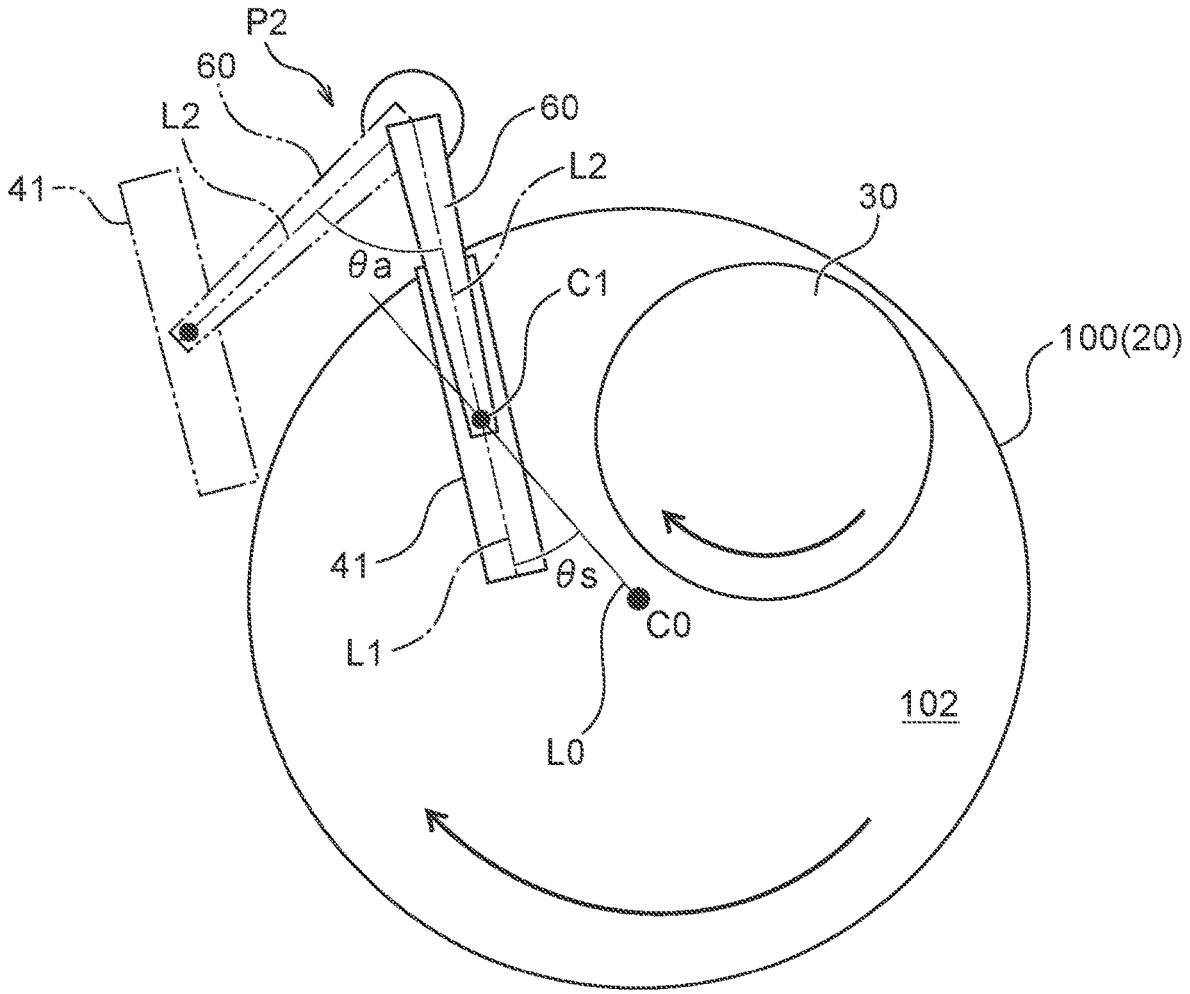
FIG. 11 is a diagram illustrating the angle of the polishing solution supply device.

FIG. 11 is a diagram illustrating the angle of the polishing solution supply device. As shown in FIG. 11, an angle θs of the polishing solution supply device 41 is defined as an angle made by a line L0 (in a radial direction of the polishing pad 100) connecting a center C0 of the polishing pad 100 with a center of rotation Cl of the polishing solution supply device 41 (the rotating shaft 481 of the motor 480 in this illustrated example) and a central axis L1 in the longitudinal direction of the polishing solution supply device 41. The angle θs has a positive value when an outer portion in the radial direction of the polishing solution supply device 41 is advanced in the rotating direction of the polishing table 20 relative to an inner portion in the radial direction of the polishing solution supply device 41 (i.e., when the inner portion in the radial direction of the polishing solution supply device 41 is delayed in the rotating direction relative to the outer portion in the radial direction of the polishing solution supply device 41). The angle θs=0 indicates that the polishing solution supply device 41 is parallel to the radial direction of the polishing pad 100. An angle θa of the arm 60 is defined as an angle of a central axis L2 in the longitudinal direction of the arm 60 at any arbitrary portion (shown by a one-dot chain line) with respect to the central axis L2 in the longitudinal direction of the arm 60 at a refuge position P2 outside of the polishing table 20 (shown by a two-dot chain line).

In the case where the polishing solution supply device 41 or the arm 60 has an asymmetric shape or the like, any axis along the longitudinal direction may appropriately be specified as L1 or L2. The angle θs and the angle θa may be determined arbitrarily as long as the angle of the polishing solution supply device 41 with respect to the polishing pad 100 and the angle of the arm 60 are definable. The axis L1 and the axis L2 may be any straight lines/line segments respectively related to the polishing solution supply device 41 and to the arm 60.

Figure 12:
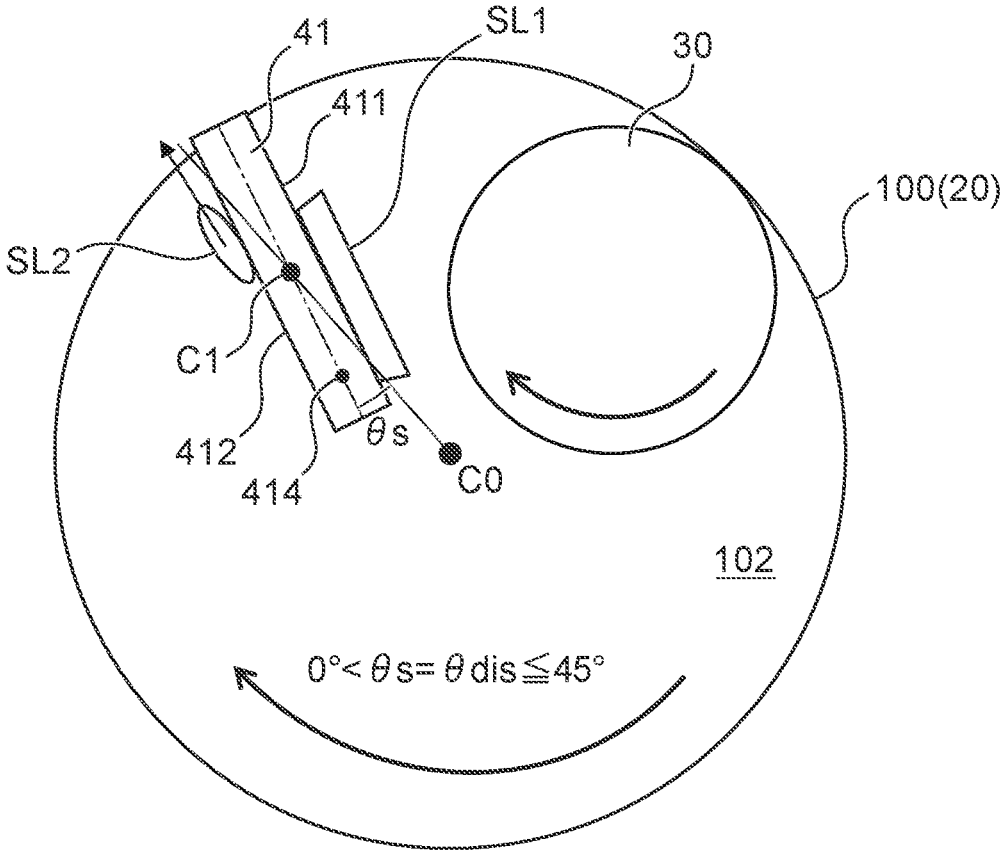
FIG. 12 is a plan view illustrating the polishing solution supply device set at an angle for accelerating discharge of used slurry.
Figure 13:
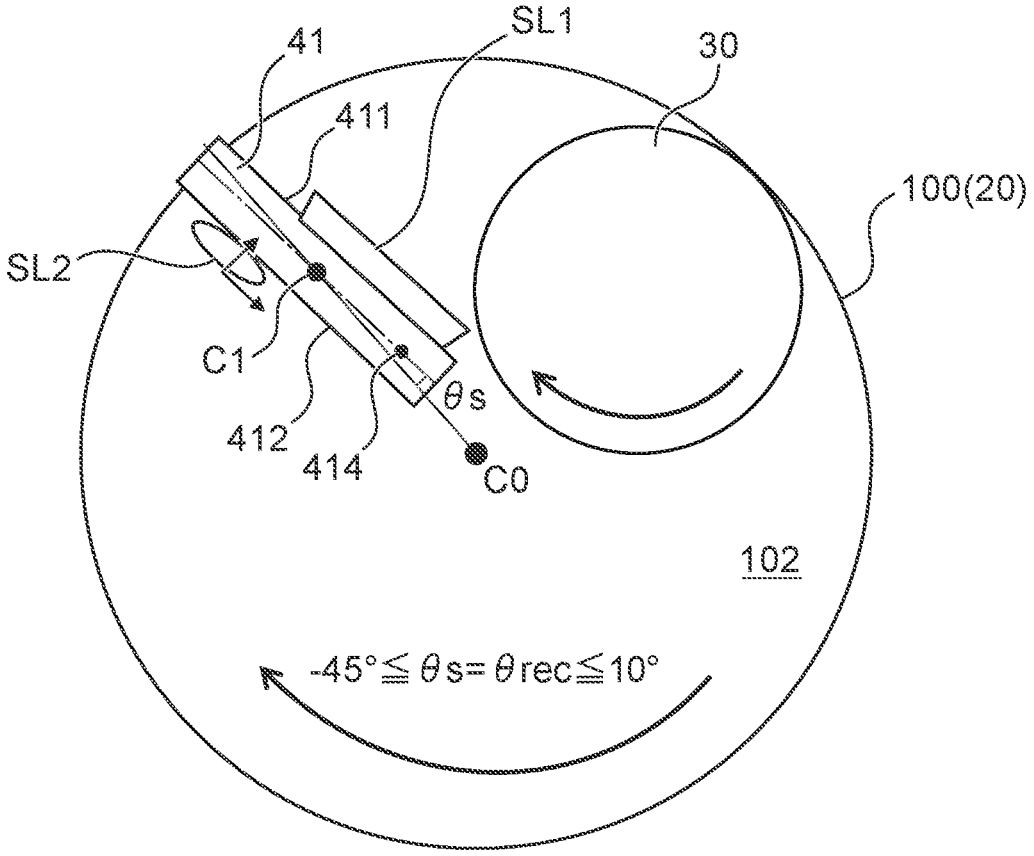
FIG. 13 is a plan view illustrating the polishing solution supply device set at angle for suppressing discharge of the used slurry.

FIG. 12 is a plan view illustrating the polishing solution supply device set at an angle for accelerating discharge of the used slurry. FIG. 13 is a plan view illustrating the polishing solution supply device set at angle for suppressing discharge of the used slurry. In the description hereof, a side face (a first lateral portion) of the polishing solution supply device 41 on the top ring 30-side is referred to as a front wall 411, and a side face (a second lateral portion) on the opposite side is referred to as a rear wall 412.

As shown in FIG. 12, setting the angle θs of the polishing solution supply device 41 to an angle θdis for accelerating discharge of the used slurry causes used slurry SL2 to be flowed toward outside of the polishing pad 100 by the rear wall 412 of the polishing solution supply device 41 (the contact member 410) and thereby accelerates discharge of the used slurry SL2 to outside of the polishing pad 100. The used slurry means slurry that is freshly supplied from the supply port 414 of the polishing solution supply device 41, is flowed from a clearance between the front wall 411 and the polishing pad 100 toward the top ring 30 (downstream in the rotating direction of the polishing pad 100), is rotated one or more full circles and is returned to the rear wall 412. This configuration suppresses/prevents the used slurry from being used for polishing the substrate and thereby suppresses/prevents deterioration of the polishing quality or improves the polishing quality. In one example, the angle θdis is set in a range of $0<\theta dis\leq 45$ degrees.

As shown in FIG. 13, setting the angle θs of the polishing solution supply device 41 to an angle θrec for suppressing discharge of the used slurry suppresses discharge of the used slurry SL2 by the rear wall 412 of the polishing solution supply device 41. The used slurry SL2 is returned toward the center C0-side of the polishing pad 100 and/or is made to pass through the polishing solution supply device 41, is spread again and is flowed toward the top ring 30-side by the rear wall 412 of the polishing solution supply device 41. This configuration enables the used slurry SL2 to be kept on the polishing pad 100 and reused. This reduces the use amount of slurry. In one example, the angle θrec is set in a range of θrec<θdis and also in a range of −45≤degrees≤θrec 10 degrees. In the description hereof, "suppressing discharge" includes the case of not discharging any slurry returned to the rear wall 412 of the polishing solution supply device 41.

The slurry drainage property (retainability) of the polishing pad 100 is varied, depending on the groove shape of the polishing pad 100 and a variety of parameters such as the viscosity of slurry. The numerical examples of the angle θdis for accelerating discharge and the angle θrec for suppressing discharge are thus merely rough indications. There is accordingly some overlap between the above numerical examples of the angle θdis for accelerating discharge and the angle θrec for suppressing discharge. The angles θdis and θrec are determined according to a process, for example, in the above numerical ranges to satisfy the condition of θrec<θdis.

The angle θs (θdis, θrec) is a relative value. The angle θs=θdis does not mean that the used slurry returned to the rear wall 412 of the polishing solution supply device 41 is fully discharged. The angle θs=θrec does not mean that the used slurry returned to the rear wall 412 of the polishing solution supply device 41 is not discharged at all. Increasing the angle θs (θdis, θrec) indicates accelerating discharge of the used slurry by the rear wall 412 of the polishing solution supply device 41, whereas decreasing the angle θs (θdis, θrec) indicates suppressing discharge of the used slurry. In other words, increasing the degree of advancement, which is the state that the outer portion in the radial direction of the polishing solution supply device 41 is advanced in the rotating direction of the polishing pad 100 relative to the inner portion in the radial direction, means increasing the discharge amount of the used slurry. Decreasing the degree of advancement, which is the state that the outer portion in the radial direction of the polishing solution supply device 41 is advanced in the rotating direction of the polishing pad 100 (including the case that the degree of advancement has a negative value, i.e., the case that the outer portion in the radial direction is delayed relative to the inner portion in the radial direction) means decreasing the discharge amount of the used slurry and increasing the ratio of the used slurry retaining on the polishing pad 100. Depending on the set value of the angle θs, there may be a case that the slurry returned to (dammed up by) the rear wall 412 of the polishing solution supply device 41 is not discharged at all.

Figure 14:
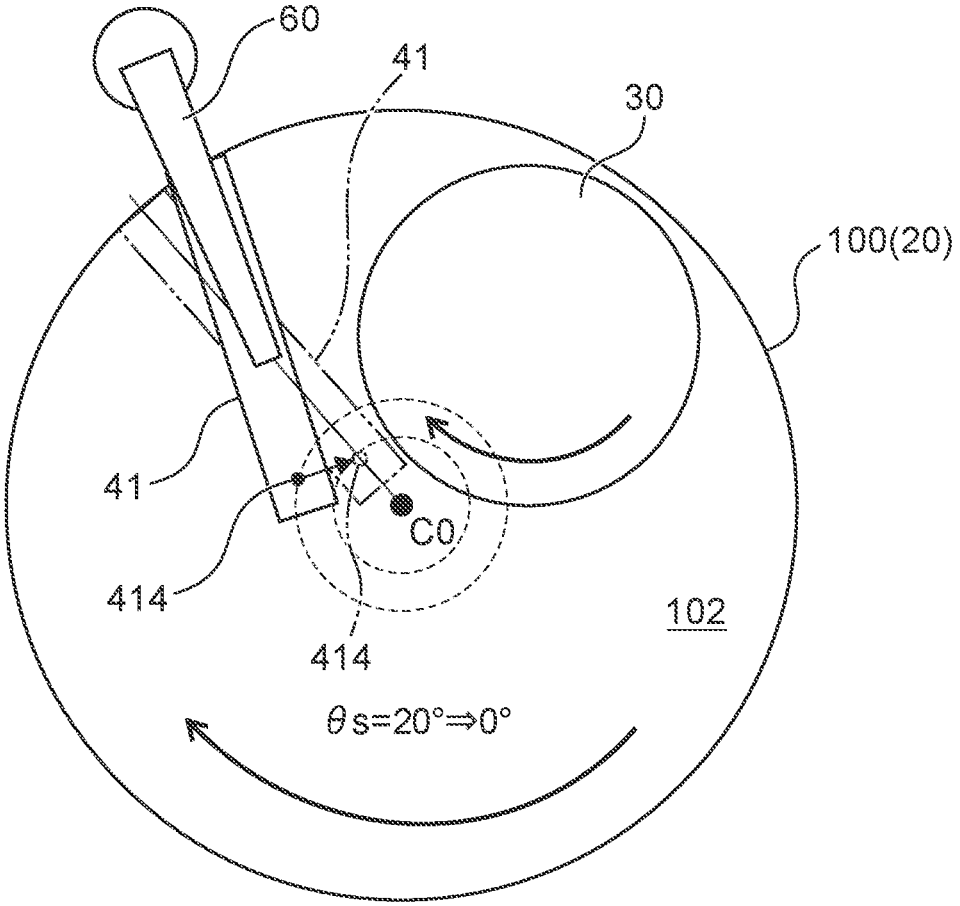
FIG. 14 is an explanatory diagram illustrating a control example of changing only the angle of the polishing solution supply device with respect to an arm without changing the angle of the arm.

FIG. 14 is an explanatory diagram illustrating a control example of changing only the angle of the polishing solution supply device with respect to the arm without changing the angle of the arm. FIG. 15 to FIG. 18 are explanatory diagrams illustrating control examples of changing both the angle of the arm and the angle of the polishing solution supply device with respect to the arm (angle relative to arm). For the convenience of explanation, FIGS. 14 to 16 and FIG. 18 illustrate the cases of changing the angle θs of the polishing solution supply device 41 from 20 degrees to 0 degree, whereas FIG. 17 illustrates the case of keeping the angle θs at 20 degree. These numerical values are merely examples for the purpose of explanation, and the angle θs may be any other numerical value. In these drawings, the polishing solution supply device 41 and the supply port 414 (the slurry dropping position) after the change are shown by two-dot chain lines.

As shown in FIG. 14, changing the angle θs without rotating the arm 60 but with rotating only the polishing solution supply device 41 with respect to the arm 60 (the polishing solution supply device 41 after the rotation is shown by the two-dot chain line) changes a clearance (interval) between the top ring 30 and the polishing solution supply device 41 as well as the slurry dropping position (the position of the supply port 414). There is a possibility that the polishing solution supply device 41 collides with the top ring 30, depending on the angle of the polishing solution supply device 41 after the rotation. The clearance (interval) is definable as the shortest distance between the two members.

As shown in FIG. 15 to FIG. 18, on the other hand, combining the rotation of the arm 60 with the rotation of the polishing solution supply device 41 with respect to the arm 60 enables a change in the slurry dropping position (the position of the supply port 414) and/or a change in the clearance (distance) between the top ring 30 and the polishing solution supply device 41 before and after the rotation to be controlled in a desired range. When rotating only the polishing solution supply device 41 without rotating the arm 60 causes no problem in the slurry dropping position (the position of the supply port 414) or in the clearance (interval) between the top ring 30 and the polishing solution supply device 41, the angle θs may be changed without rotating the arm 60 but with rotating only the polishing solution supply device 41.

Figure 15:
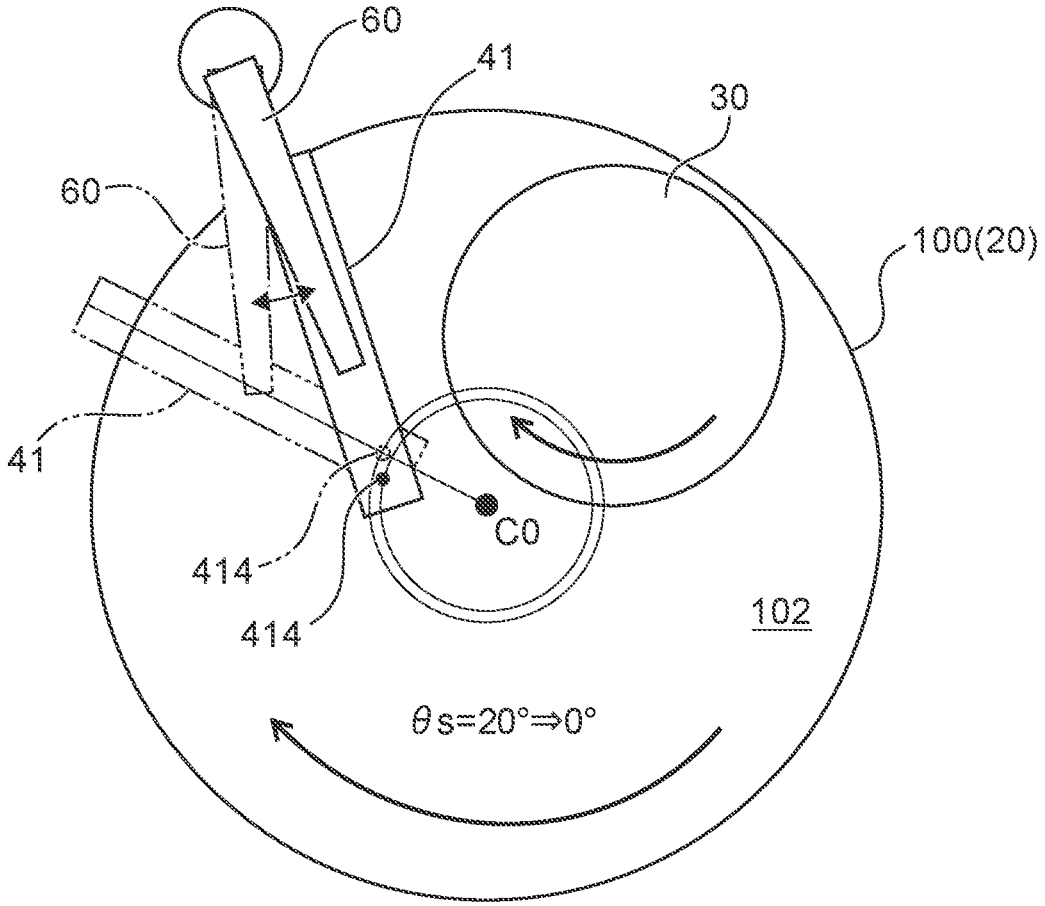
FIG. 15 is an explanatory diagram illustrating a control example of changing both the angle of the arm and the angle of the polishing solution supply device with respect to the arm.

In the example of FIG. 15, a specific slurry dropping position (a specific position of the supply port 414) is determined, and the rotation of the arm 60 and the rotation of the polishing solution supply device 41 (with respect to the arm 60) are combined with each other, such as to set the angle θs of the polishing solution supply device 41 after the angle change to a desired value (0 degree in this example) and to minimize the shift of the slurry dropping position (the position of the supply port 414) before and after the angle change. Combining the rotation of the arm 60 with the rotation of the polishing solution supply device 41 can suppress a variation in the slurry dropping position (the position of the supply port 414) at each angle θs or can control the slurry dropping position (the position of the supply port 414) to a position close to a preset position at each angle θs. In the illustrated example of FIG. 15, the angle θs varies from 20 degrees to 0 degree. The moved position of the arm 60, the moved position of the polishing solution supply device 41 and the moved slurry dropping position (the moved position of the supply port 414) are shown by the two-dot chain lines.

Figure 16:
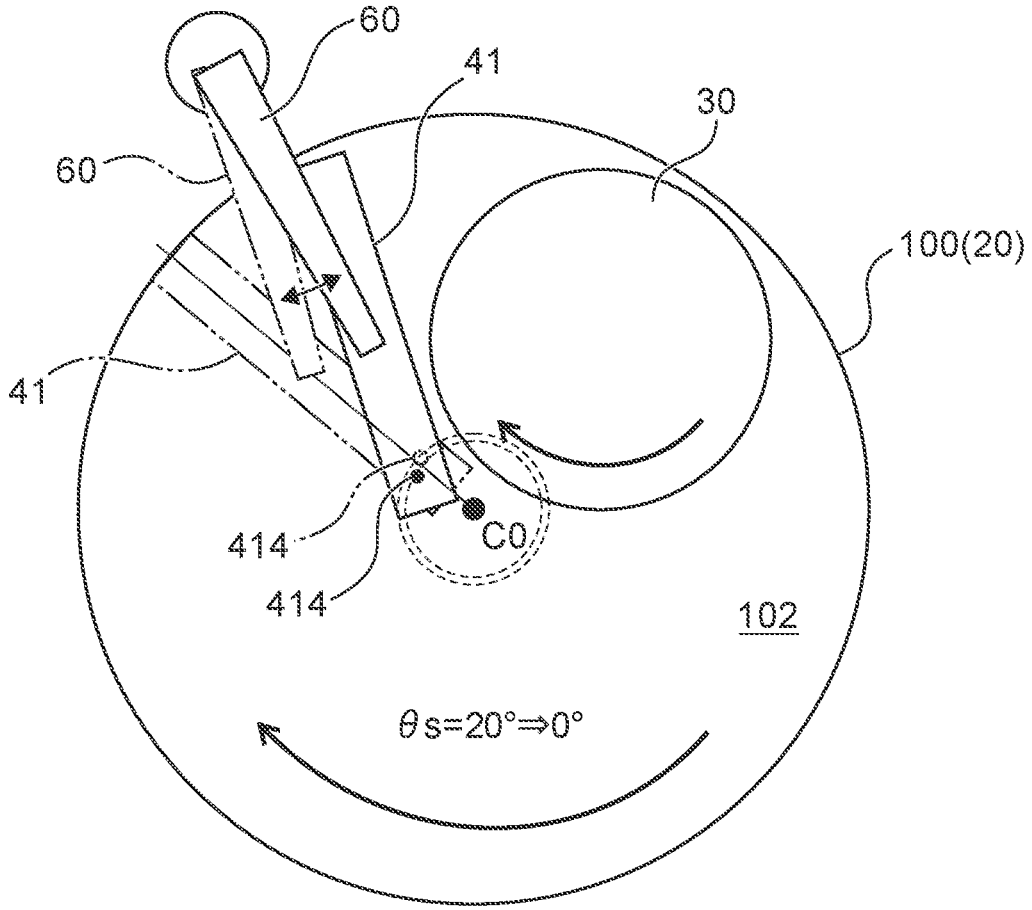
FIG. 16 is an explanatory diagram illustrating a control example of changing both the angle of the arm and the angle of the polishing solution supply device with respect to the arm.
Figure 17:
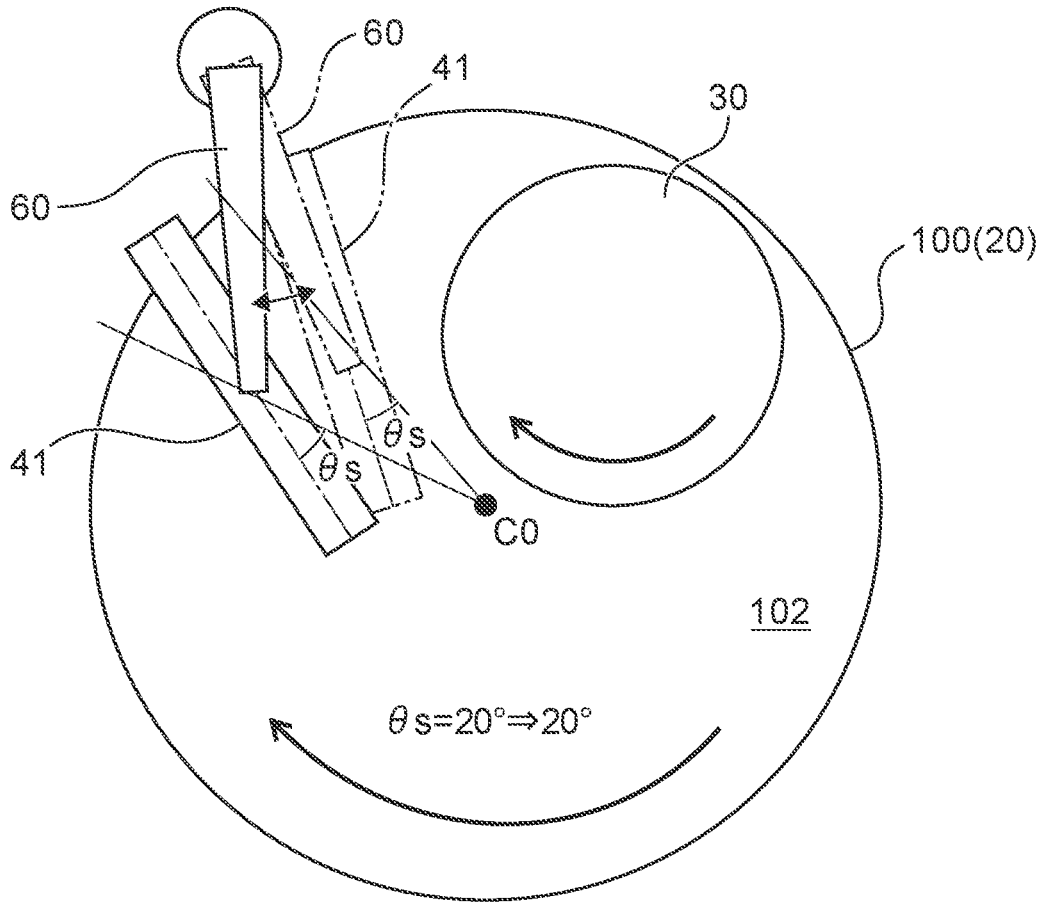
FIG. 17 is an explanatory diagram illustrating a control example of changing both the angle of the arm and the angle of the polishing solution supply device with respect to the arm.

In the example of FIG. 16, a control is performed to make the slurry dropping position (the position of the supply port 414) closest to the center C0 of the polishing pad 100 (i.e., to minimize the distance between the supply port 414 and the center C0 after the changed angle) at each angle θs in such a range that the polishing solution supply device 41 does not come into contact with the top ring 30 (in such a range that the interval between the polishing solution supply device 41 and the top ring 30 does not become less than a predetermined value). Combining the rotation of the arm 60 with the rotation of the polishing solution supply device 41 can control the slurry dropping position (the position of the supply port 414) to a position close to the center C0 of the polishing pad 100 at each angle θs. In the illustrated example of FIG. 16, the angle θs varies from 20 degrees to 0 degree.

The moved position of the arm 60, the moved position of the polishing solution supply device 41 and the moved slurry dropping position (the moved position of the supply port 414) are shown by the two-dot chain lines.

In the example of FIG. 17, a control is performed to rotate/move the arm 60 and the polishing solution supply device 41, while keeping constant the angle θs of the polishing solution supply device 41 with respect to the polishing pad 100. Combining the rotation of the arm 60 with the rotation of the polishing solution supply device 41 enables the polishing solution supply device 41 to be scanned on the polishing pad 100 in the state that the angle θs is kept constant. In the illustrated example of FIG. 17, the arm 60 is moved, while the angle θs is kept at 20 degrees. The moved position of the arm 60 and the moved position of the polishing solution supply device 41 are shown by the two-dot chain lines.

Figure 18:
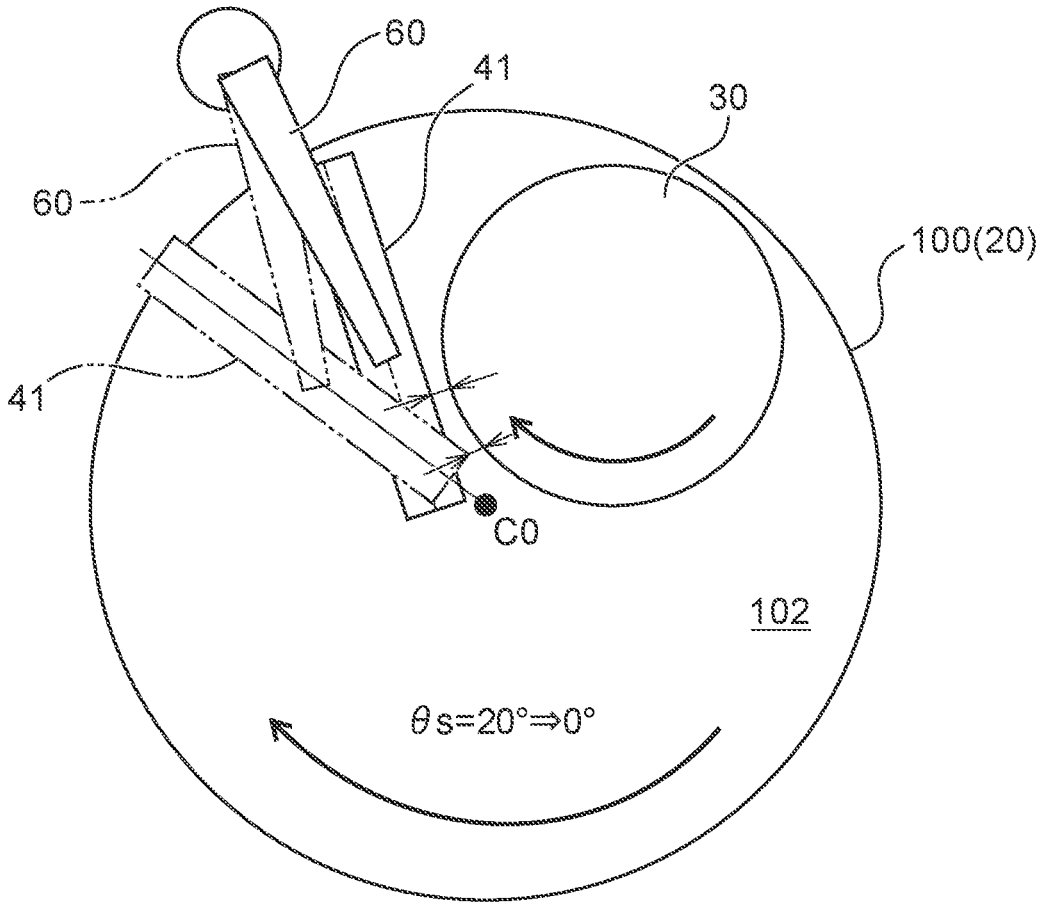
FIG. 18 is an explanatory diagram illustrating a control example of changing both the angle of the arm and the angle of the polishing solution supply device with respect to the arm.

In the example of FIG. 18, in the process of changing the angle θs (changing the mounting angle of the polishing solution supply device 41), the rotation of the arm 60 and the rotation of the polishing solution supply device 41 are combined with each other, such as to keep the clearance between the polishing solution supply device 41 and the top ring 30 constant (such as not to bring the polishing solution supply device 41 into contact with the top ring 30). Combining the rotation of the arm 60 with the rotation of the polishing solution supply device 41 enables the interval between the polishing solution supply device 41 and the top ring 30 to be maintained in an appropriate range at each angle θs and reliably avoids a collision of the polishing solution supply device 41 with the top ring 30. In the illustrated example of FIG. 18, the angle θs varies from 20 degrees to 0 degree. The moved position of the arm 60 and the moved position of the polishing solution supply device 41 are shown by the two-dot chain lines. In other control examples including the examples of FIGS. 15 to 17, the control may be performed such that the interval between the top ring 30 and the polishing solution supply device 41 does not become less than a predetermined value (i.e., the interval becomes equal to or greater than the predetermined value or the interval is kept constant).

FIG. 19 illustrates an example of data configuration including the angle θs of the polishing solution supply device 41 and the angle θa of the arm 60 corresponding to the angle θs. The angle θa of the arm 60 may be calculated with respect to each desired angle θs of the polishing solution supply device 41 by the controller 200 of the polishing apparatus 1. In another example, calculation results as shown in FIG. 19 may be incorporated in advance in a recipe. The data shown in FIG. 19 may be stored in advance, for example, in a storage medium of the controller 200 or in a storage medium which the controller 200 is communicable with by wire or wirelessly. The angle θs set corresponding to a polishing rate (and/or a time change in the polishing rate) may be stored in advance in the storage medium. Furthermore, respective angles used at steps S28, S29 and S30 in FIG. 21 described later (the angle θa of the arm 60 corresponding to a refuge standby position, the angle θs for refuge of the polishing solution supply device 41 and the angle θa of the arm 60 corresponding to a refuge position outside of the polishing pad 100) may also be stored in the storage medium.

Figure 20:
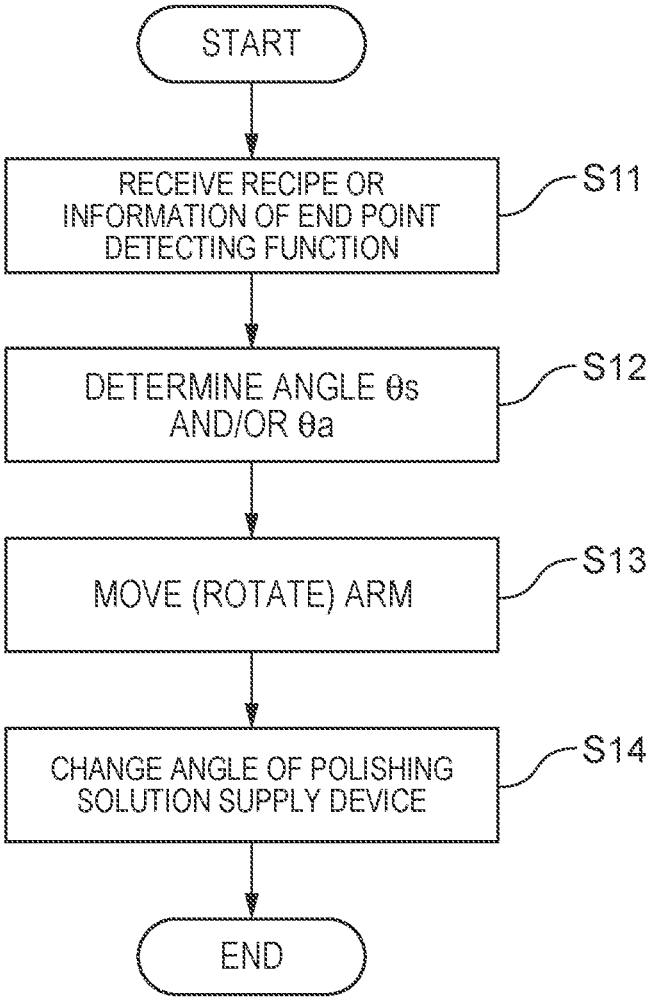
FIG. 20 is a flowchart showing a control example of changing the angle of the polishing solution supply device.

FIG. 20 is a flowchart showing a control example of changing the angle θs of the polishing solution supply device 41. The processing of this flowchart is performed at steps S22, S25, S26 and S29 in FIG. 21 described later.

At step S11, the controller 200 obtains a recipe or, for example, film thickness distribution information obtained by an end point detection device 210 of the polishing apparatus 1 shown in FIG. 1 and calculates a polishing rate from the film thickness distribution information. The controller 200 subsequently determines whether an angle change is to be performed or not, based on the calculated polishing rate.

At step S12, the controller 200 determines the angle θs of the polishing solution supply device 41, based on the recipe or based on the information of the polishing rate calculated from the film thickness distribution obtained by the end point detection device 210. In the case of angle control based on the recipe, the controller 200 performs a recipe operation set by the user (using the angles θs and θa set by the user). In the case of determining the angle θs based on the polishing rate calculated from the film thickness distribution obtained by the end point detection device 210, the controller 200 reads out the angle θs stored in advance, according to the polishing rate (and/or a value related to the polishing rate). The controller 200 subsequently determines the angle θa of the arm 60, based on the determined angle θs, by referring to a database (shown in FIG. 19) or by calculation.

At step S13, the controller 200 rotates the arm 60 to the determined angle θa. At step S14, the controller 200 rotates the polishing solution supply device 41 with respect to the arm 60 until the angle of the polishing solution supply device 41 becomes equal to the determined angle θs. The sequence of the rotation of the arm 60 (S13) and the rotation of the polishing solution supply device 41 (S14) is changed appropriately according to the angles θs and θa before and after the change, such as to prevent the polishing solution supply device 41 from colliding with the top ring 30.

When there is no need to rotate the arm 60, the rotation of the arm (S13) is omitted in the flowchart of FIG. 20.

Figure 21:
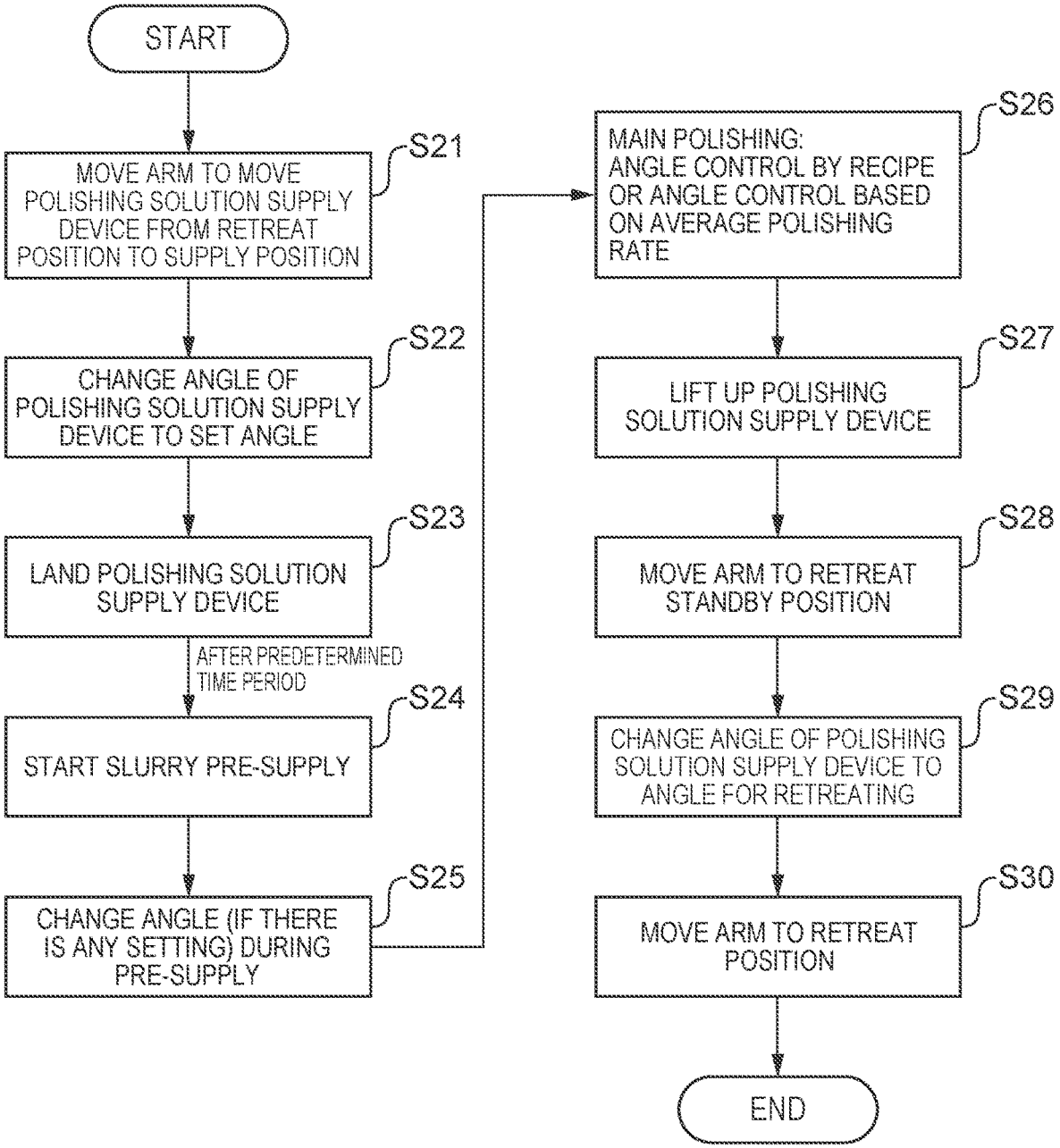
FIG. 21 is a flowchart showing an example of entire polishing process.

FIG. 21 is a flowchart showing an example of entire polishing process. The flowchart of this example shows a main polishing flow.

Steps S21 to S23 are processes prior to slurry pre-supply. The slurry pre-supply is a process of supplying and spreading the slurry onto the polishing pad 100 before the substrate is brought into contact with the polishing pad 100. At step S21, the polishing solution supply device 41 is moved from a refuge position (outside of the polishing pad 100) to a supply position (above the polishing pad 100) by rotating the arm 60. At step S22, the angle θs of the polishing solution supply device is changed to a preset angle (as shown in the flowchart of FIG. 20). At step S23, the polishing solution supply device 41 is landed on the polishing pad 100 to be ready for supply of the slurry. The rotation of the polishing table 20 may be started before the process of step S23 or after the process of step S23.

Steps S24 and S25 are pre-supply processes to supply the slurry onto the polishing pad 100 in the state that the substrate is not brought into contact with the polishing pad 100. Step S24 is performed at a predetermined time after the process of step S23 (for example, after 0 second to 5 seconds). At step S24, the slurry pre-supply from the polishing solution supply device 41 is started. When there is a setting to change the angle θs of the polishing solution supply device 41 during the slurry pre-supply, the angle θs is changed in the course of slurry pre-supply at step S25 (as shown in the flowchart of FIG. 20).

Step S26 is a substrate polishing process. At step S26, the top ring 30 holding the substrate is landed on the polishing pad 100, and polishing of the substrate is started. In the course of polishing the substrate, the angle control of the angle θs of the polishing solution supply device 41 by using the recipe and the angle control of the angle θs based on the polishing rate are performed (as shown in the flowchart of FIG. 20). The angle control by using the recipe performs the recipe operation set by the user. In this process, the angle may be changed at every step. In the case of angle control based on an average polishing rate, with a view to obtaining the polishing rate during polishing of the substrate, there is a need to obtain film thickness distribution data in the plane of the substrate as original data. An exemplified procedure uses film thickness distribution data obtained by the end point detection device 210 which is provided with an EPD (end point detection) sensor, for example, an eddy-current sensor (RECM: reactance-eddy current monitor) or an optical sensor (SOPM: spectrum optical endpoint monitoring sensor), to calculate an average polishing rate and/or a derivative of the average polishing rate and performs the angle control based on the average polishing rate and/or the derivative of the average polishing rate. Although not being specifically illustrated, one or multiple EPD sensors are placed inside of the polishing table 20 and are moved with rotation of the polishing table 20 to pass through the in-plane of the substrate held by the top ring 30. While passing through the in-plane of the substrate, the EPD sensor measures a film thickness distribution in the plane of the substrate and detects an end point of polishing according to the measured film thickness distribution or a variation in the average film thickness. The film thickness distribution data obtained by the end point detection device 210 using this EPD sensor as the film thickness sensor is sent to the controller 200, and the controller 200 controls the angle θs of the polishing solution supply device 41, based on this information of film thickness distribution.

Figure 27:
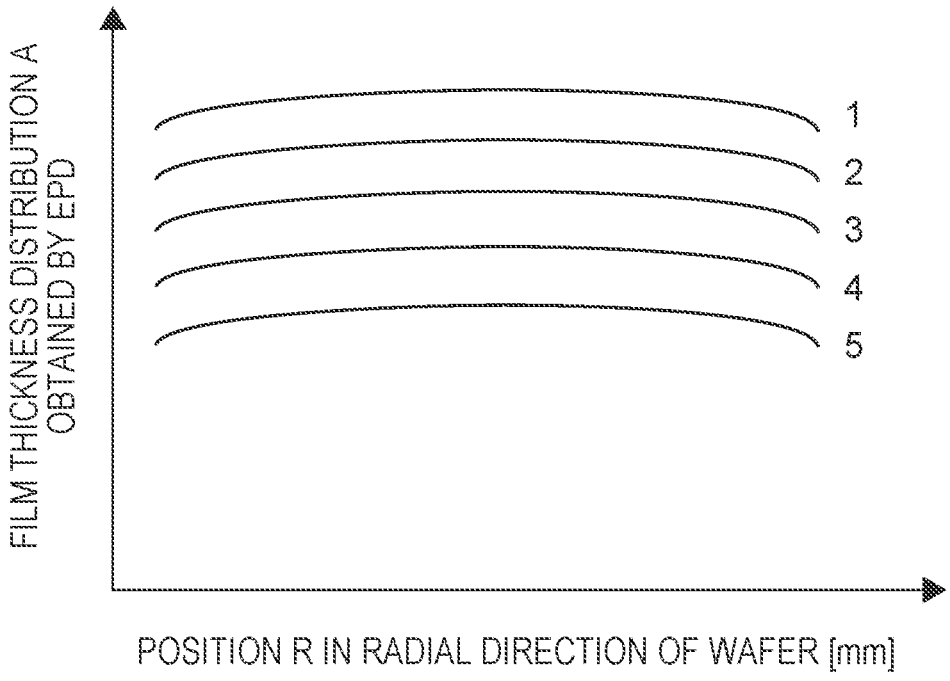
FIG. 27 is an explanatory diagram illustrating an example of deriving a polishing rate using an end point detection device.

Derivation of the polishing rate (average polishing rate) using the end point detection device 210 may be performed, for example, by the following procedure. FIG. 27 is an explanatory diagram illustrating an example of deriving the polishing rate using the end point detection device 210. Curves 1 to 5 in the graph of FIG. 27 respectively show film thickness distributions of the substrate after one rotation to five rotations of the polishing table. In this example, the polishing rate is calculated according to Equation 1 given below:

$$R=(\text{Thic1}-\text{Thic5})/\text{Tlaps} \quad \text{(Equation 1)}$$

where R denotes an average polishing rate, Thic1 denotes an average film thickness distribution after one rotation of the polishing table, Thic5 denotes an average film thickness distribution after five rotations of the polishing table, and Tlaps denotes a time elapsed from the time after one rotation of the polishing table to the time after five rotations of the polishing table.

Figure 22:
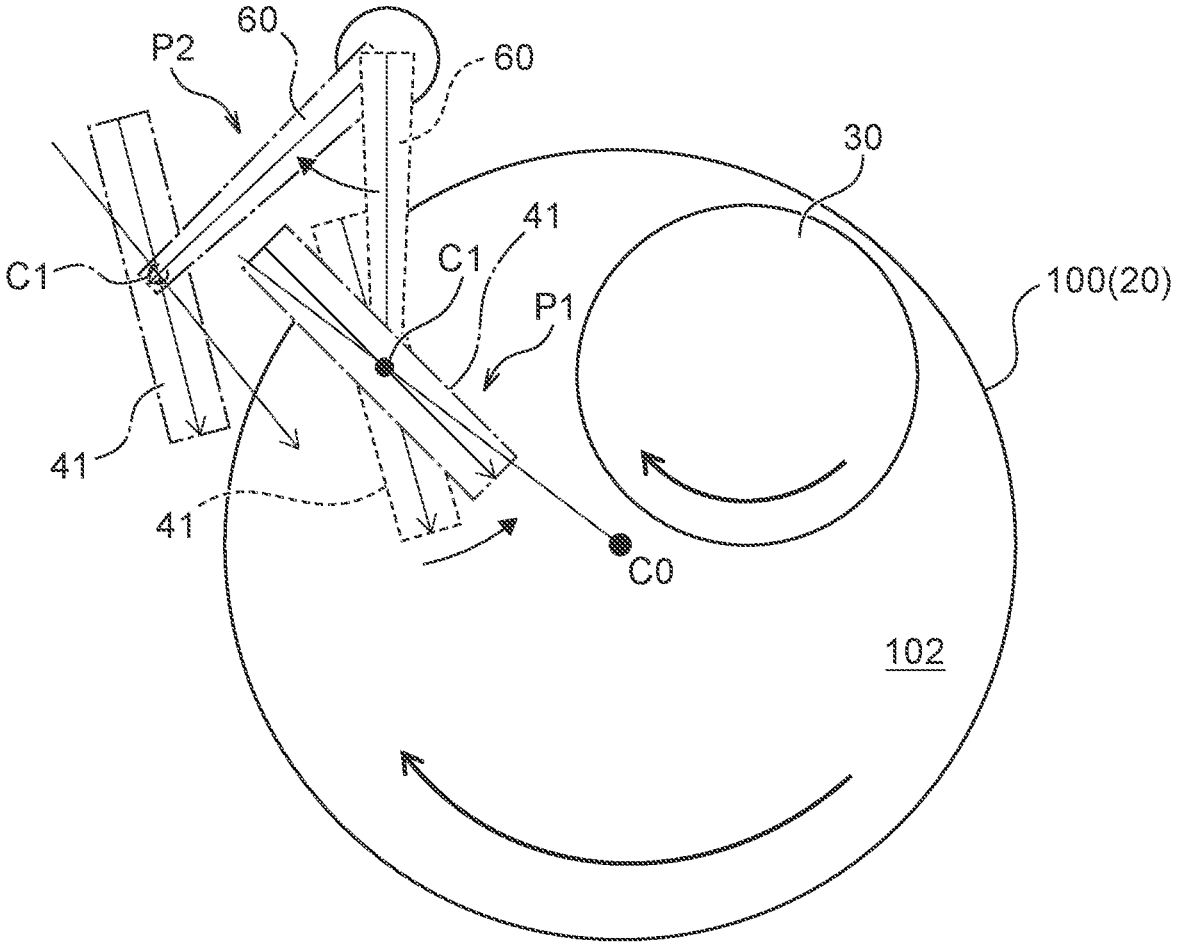
FIG. 22 is an explanatory diagram illustrating a procedure of moving the polishing solution supply device to a refuge position.

Steps S27 to S30 are processes after the polishing process (operations at the time of retreating the polishing solution supply device 41). FIG. 22 is an explanatory diagram illustrating a procedure of moving the polishing solution supply device 41 to the refuge position. At step S27, the polishing solution supply device 41 is lifted up at a polishing end position, so as to be separated from the polishing pad 100. At step S28, as shown in FIG. 22, the arm 60 is moved to a refuge standby position P1 for retreating. At step S29, at the refuge standby position P1, the polishing solution supply device 41 is rotated with respect to the arm 60, so as to change the position of the polishing solution supply device 41 to an angle for retreating. The positions of the polishing solution supply device 41 before and after the change to the angle for retreating at the refuge standby position P1 are respectively shown by leading lines of the broken line and the one-dot chain line in FIG. 22. At step S30, the arm 60 is rotated, so that the arm 60 and the polishing solution supply device 41 are moved to a refuge position P2. The positions of the arm 60 at the refuge standby position P1 and at the refuge position P2 are respectively shown by leading lines of the broken line and the one-dot chain line in FIG. 22.

At the time of retreating the polishing solution supply device 41, the polishing solution supply device 41 is rotated after the arm 60 is moved to the refuge standby position P1. This is because there is a possibility that the polishing solution supply device 41 collides with the top ring 30 when the polishing solution supply device 41 is rotated at the polishing end position of the arm 60. Rotating the polishing solution supply device 41 after moving the arm 60 to the refuge standby position P1 prevents the polishing solution supply device 41 from colliding with the top ring 30.

(Example of Angle Control at Pre-Supply Time)

Figure 23:
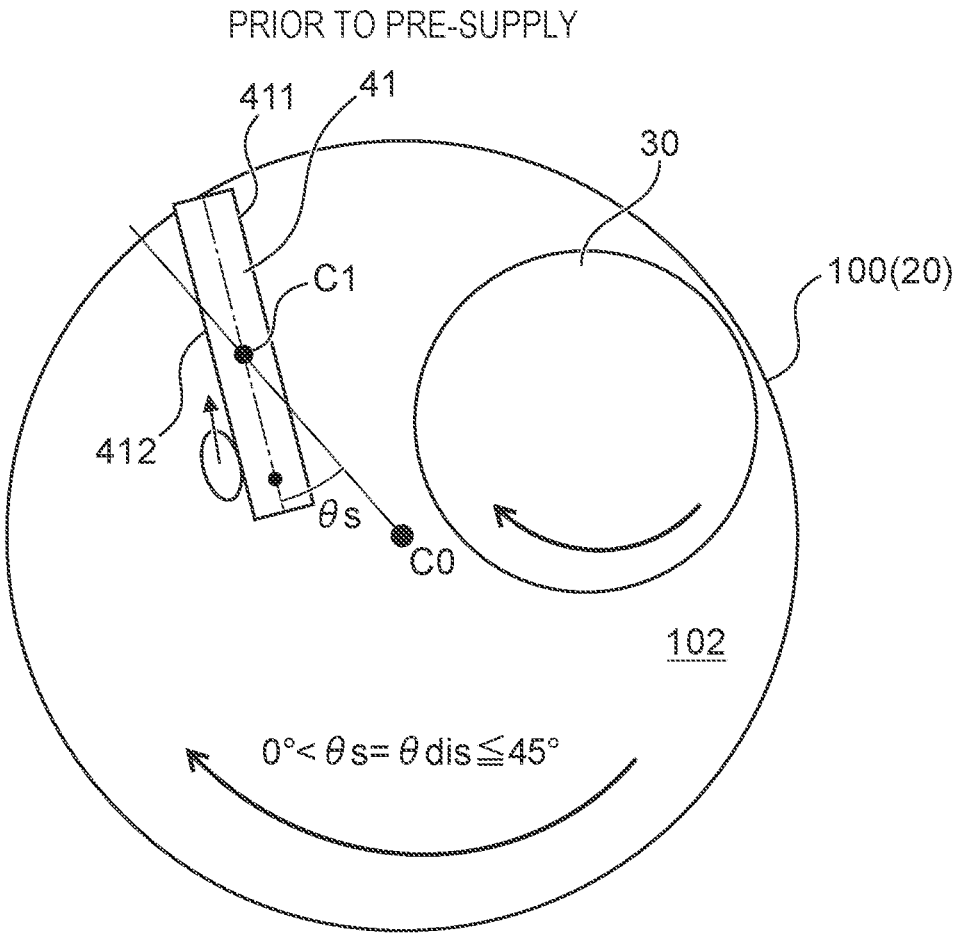
FIG. 23 is an explanatory diagram illustrating one example of angle control by using a recipe.
Figure 24:
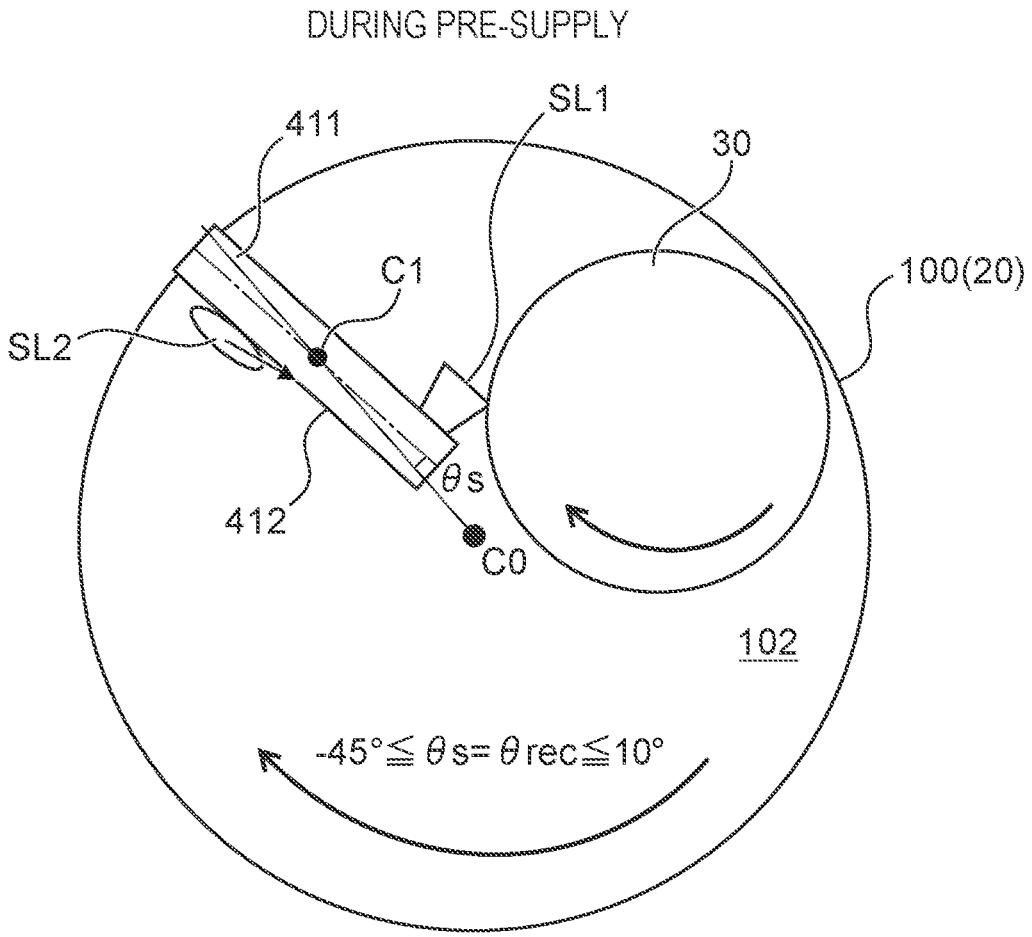
FIG. 24 is an explanatory diagram illustrating one example of angle control by using the recipe.

FIG. 23 and FIG. 24 are explanatory diagrams illustrating one example of angle control by using a recipe and illustrate angle control before pre-supply and after a start of pre-supply. For example, in the case of using the polishing pad 100 having poor drainage, the angle θs of the polishing solution supply device 41 is set to the angle θdis for accelerating discharge (for example, 0<θdis≤45 degrees) before slurry pre-supply (at step S22 in FIG. 21), as shown in FIG. 23. The polishing solution supply device 41 is then landed (at step S23 in FIG. 21), and the fluid on the polishing pad 100 is discharged to outside of the polishing pad 100 by the rear wall 412 of the polishing solution supply device 41 by means of rotation of the polishing pad 100 for a predetermined time period before a start of slurry pre-supply (at step S24). The predetermined time period may be in a range of, for example, 0<predetermined time period 5 seconds. The angle θs may subsequently be set to the angle θrec for suppressing discharge of the slurry (for example, −45 degrees≤θrec≤10 degrees) as shown in FIG. 24 at any timing (at step S25) before or after the start of the slurry pre-supply (at step S24). The angle of suppressing discharge of the slurry denotes the angle that suppresses the used slurry SL2 from being discharged and that causes the used slurry SL2 to be returned toward the center C0-side of the polishing pad 100 and/or to pass through the polishing solution supply device 41 and to be flowed again toward the top ring 30-side by the rear wall 412 of the polishing solution supply device 41 as described above. Polishing the substrate is not performed during the slurry pre-supply, so that there is little possibility slurry deterioration. It is accordingly preferable to suppress discharge of the slurry, and to cause the slurry to be kept on the polishing pad 100 and reused, and thereby to reduce the use amount of the slurry. The angle θs may not be necessarily changed after the start of the slurry pre-supply (at step S24).

In this example, setting the angle θs of the polishing solution supply device 41 to the angle θdis for accelerating discharge before the start of the slurry pre-supply enables the fluid on the polishing pad 100 to be discharged before the slurry is supplied onto the polishing pad 100. After the start of the slurry supply, the angle θs of the polishing solution supply device 41 may be changed to the angle θrec for suppressing discharge. This suppresses the fresh slurry from being discharged during the slurry pre-supply.

In the case of using the polishing pad 100 having good drainage to sufficiently remove the fluid on the polishing pad 100 by only rotation of the polishing pad 100, the angle θs may be set to the angle θrec for suppressing discharge of the slurry at the time of starting the pre-supply or prior to the start of the pre-supply (for example, at the time of step S22) as shown in FIG. 24. Setting this angle θs=θrec suppresses discharge of the slurry and reduces the use amount of the slurry.

(Example of Angle Control by Using Recipe During Polishing)

One exemplified procedure of angle control by using the recipe during polishing may set the angle θs of the polishing solution supply device 41 to the angle θdis for accelerating discharge of the slurry (0<θdis≤45 degrees) as shown in FIG. 12. In this example, the angle θs is fixed to θdis during polishing. As shown in FIG. 12, setting the angle θs to θdis causes the fresh slurry SL1 to be supplied from the front wall 411 of the polishing solution supply device 41 toward the top ring 30-side and to be used to polish the substrate, while accelerating discharge of the used slurry SL2 out of the polishing pad 100 by the rear wall 412. This suppresses/prevents deterioration of the polishing quality or improves the polishing quality. For example, in the case of using slurry that is more likely to deteriorate in the progress of polishing, this configuration suppresses/prevents the deteriorating slurry from being used for polishing and suppresses/prevents deterioration of the polishing quality or improves the polishing quality.

Another exemplified procedure of angle control by using the recipe during polishing may set the angle θs of the polishing solution supply device 41 to the angle θrec for suppressing discharge of the used slurry (θrec<θdis, −45 degrees≤θrec≤10 degrees) as shown in FIG. 13. As shown in FIG. 13, setting the angle θs of the polishing solution supply device 41 to θrec causes the used slurry SL2 to be flowed along the rear wall 412 of the polishing solution supply device 41 toward the center C0-side of the polishing pad 100 or causes the used slurry SL2 to pass through the polishing solution supply device 41, to be spread again and to be flowed toward the top ring 30-side. This enables the used slurry SL2 to be reused for polishing the substrate, in addition to the fresh slurry SL1 supplied from the supply port 414 of the polishing solution supply device 41. This enables the used slurry SL2 to be reused for polishing the substrate and thereby reduces the use amount of the slurry. For example, in the case of using slurry that is unlikely to deteriorate in the progress of polishing, this configuration enables the used slurry SL2 to be used for polishing the substrate and reduces the use amount of the slurry, while suppressing/preventing deterioration of the polishing quality.

Another exemplified procedure of angle control by using the recipe during polishing may perform control of changing over the angle θs of the polishing solution supply device 41 between the angle θdis for accelerating discharge of the used slurry and the angle θrec for suppressing discharge of the used slurry. While the slurry is fresh, as shown in FIG. 13, the angle θs is changed over to θrec (<θdis, −45 degrees≤θrec≤10 degrees) and causes the used slurry SL2 to be kept on the polishing pad 100. Accordingly, the used slurry SL2 is returned toward the center C0-side of the polishing pad 100 and/or is made to pass through the polishing solution supply device 41, to be spread again and to be flowed toward the top ring 30-side by the rear wall 412 of the polishing solution supply device 41. This has similar functions and advantageous effects to those described above with regard to the angle control of setting θs=θrec. When the slurry becomes old, as shown in FIG. 12, the angle θs is changed over to θdis (0<θdis≤45 degrees) and accelerates discharge of the used slurry SL2. This has similar functions and advantageous effects to those described above with regard to the angle control of setting θs=θdis. The interval of changing over between suppression of discharge (acceleration of reuse) of the used slurry and acceleration of discharge of the used slurry may be set by the user. This may be used in combination with changeover control based on the polishing rate (described later).

This exemplified procedure changes over between suppression of discharge (acceleration of reuse) and acceleration of discharge according to the state of the used slurry. This accordingly causes the relatively fresh used slurry having polishing performance to be reused for polishing the substrate and thereby reduces the use amount of the slurry, while discharging the old used slurry without using the old used slurry to polish the substrate and thereby suppressing/preventing deterioration of the polishing quality. This enhances the compatibility between reduction of the use amount of the slurry and maintenance of the polishing quality.

(Example of Angle Control by Automatic Control During Polishing)

Figure 25:
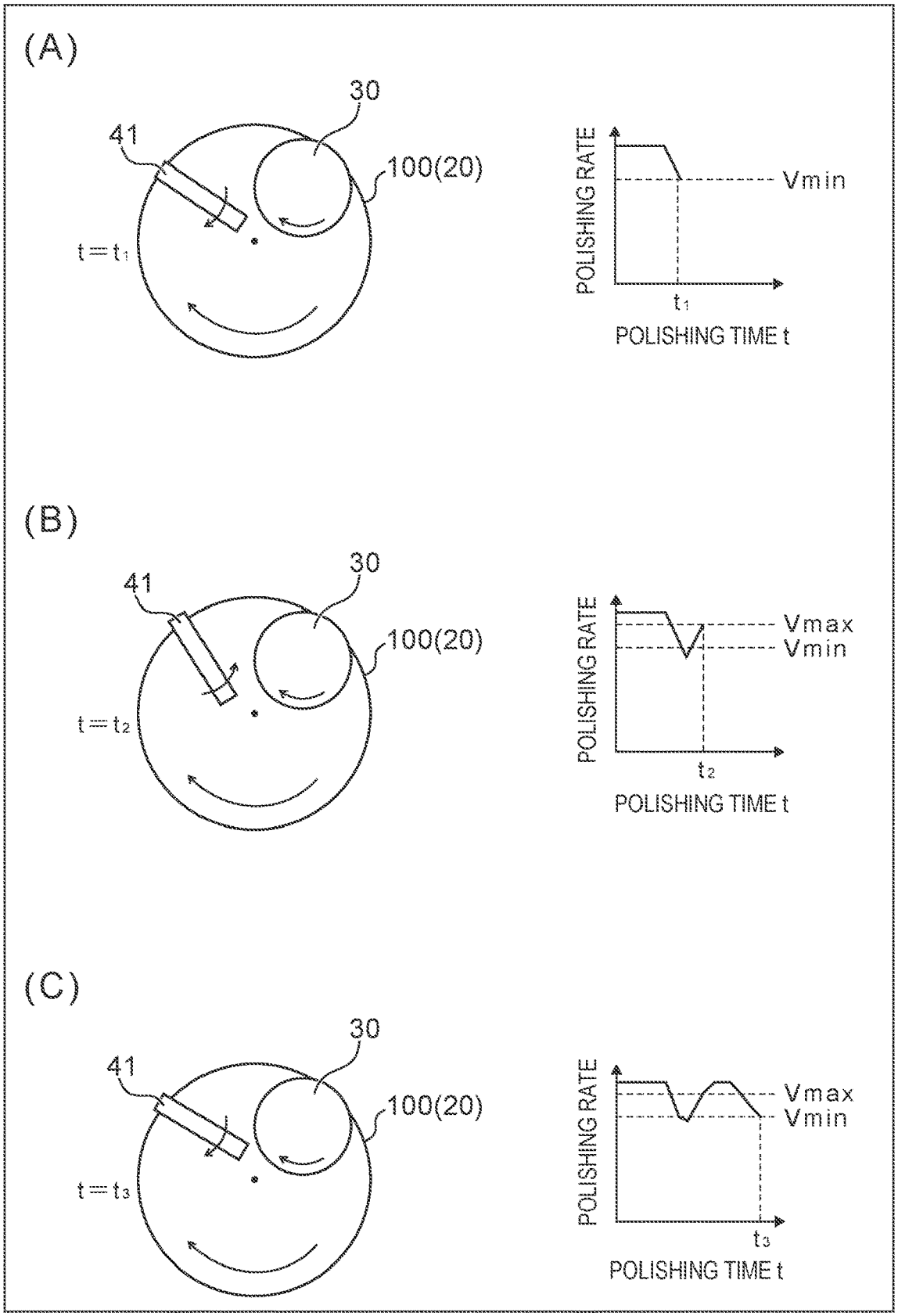
FIG. 25 is explanatory diagrams illustrating one example of automatic control of the angle of the polishing solution supply device during main polishing.

FIG. 25 illustrates an example of automatic control (feedback control) of the angle of the polishing solution supply device during polishing. In this example, at step S26 in FIG. 21, a procedure of automatic control monitors the polishing rate calculated from the film thickness distribution obtained by the end point detection device 210 and changes the angle θs based on the polishing rate.

In the course of polishing, the controller 200 monitors the polishing rate calculated from the film thickness distribution obtained by the end point detection device 210, determines that the used slurry becomes old/deteriorates when a polishing rate V becomes equal to a set lower limit value Vmin (FIG. 25(A), at a time t=t1), and changes the angle θs of the polishing solution supply device 41 to θdis (0<θdis≤45 degrees). This accelerates discharge of the used slurry. Accelerating discharge of the used slurry reduces the used slurry supplied to the top ring 30. This suppresses/prevents the old slurry from being used to polish the substrate and increases the polishing rate.

When the polishing rate V is increased and becomes equal to a set upper limit value Vmax (FIG. 25(B), at the time t=t2), the controller 200 changes the angle θs of the polishing solution supply device 41 to θrec (<θdis, −45 degrees≤θrec≤10 degrees). This suppresses discharge of the used slurry or keeps the used slurry on the polishing pad 100 (causes the used slurry to be flowed along the rear wall 412 of the polishing solution supply device 41 toward the center C0-side of the polishing pad 100 and/or to pass through the polishing solution supply device 41, to be spread again and to be flowed toward the top ring 30-side). This suppresses discharge of the used slurry and increases the ratio of the used slurry kept on the polishing pad 100. This enables the used slurry to be reused for polishing the substrate and reduces the use amount of the slurry.

When the polishing rate V becomes equal to the set lower limit value Vmin again (FIG. 25(C), at the time t=t3), the controller 200 determines that the used slurry becomes old/deteriorates and changes the angle θs of the polishing solution supply device 41 to θdis (0<θdis≤45 degrees). This accelerates discharge of the used slurry. After that, the controller 200 repeatedly changes over the setting of the angle θs between θdis and θrec, based on the detection value of the polishing rate. The configuration of monitoring the polishing rate enables the setting of the angle to be changed over between acceleration of discharge of the used slurry and acceleration of reuse of the used slurry, based on the actual state (the degree of deterioration) of the used slurry, and further enhances the compatibility between reduction of the use amount of the slurry and maintenance of the polishing quality. A modification may change the angle when the state that the polishing rate V is equal to or lower than the lower limit value Vmin continues for a predetermined time period or when the state that the polishing rate V is equal to or higher than the upper limit value Vmax continues for a predetermined time period.

Figure 26:
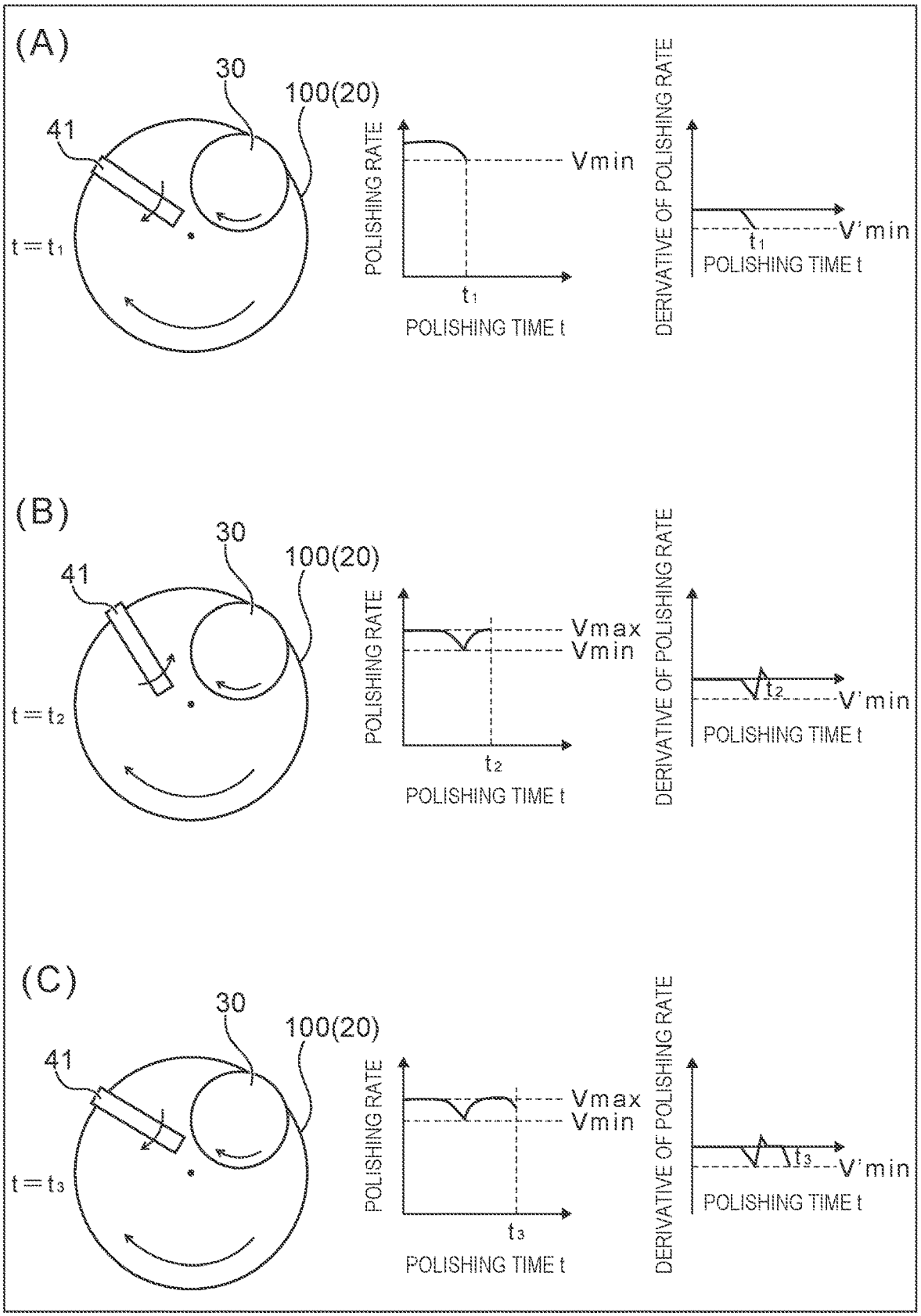
FIG. 26 is explanatory diagrams illustrating another example of automatic control of the angle of the polishing solution supply device during main polishing.

FIG. 26 illustrates another example of automatic control (feedback control) of the angle of the polishing solution supply device during polishing. This example is a modification of the example of FIG. 25.

In the course of polishing, the controller 200 monitors a derivative value V that is a time derivative of the polishing rate calculated from the film thickness distribution obtained by the end point detection device 210, determines that the used slurry becomes old/deteriorates when the derivative value V of the polishing rate has a negative value and becomes equal to a set lower limit value V'min (FIG. 26(A), at a time t=t1), and changes the angle θs of the polishing solution supply device 41 to θdis (0<θdis≤45 degrees). This accelerates discharge of the used slurry. Accelerating discharge of the used slurry reduces the used slurry supplied to the top ring 30. This suppresses/prevents the old slurry from being used to polish the substrate and increases the polishing rate.

When the derivative value V of the polishing rate decreases from a positive value to zero (FIG. 26(B), at the time t=t2), the controller 200 determines that the old slurry is sufficiently discharged and changes the angle θs of the polishing solution supply device 41 to θrec (<θdis, −45 degrees θrec 10 degrees). This suppresses discharge of the used slurry or keeps the used slurry on the polishing pad 100 (causes the used slurry to be flowed along the rear wall 412 of the polishing solution supply device 41 toward the center C0-side of the polishing pad 100 and/or to pass through the polishing solution supply device 41, to be spread again and to be flowed toward the top ring 30-side). This suppresses discharge of the used slurry and increases the ratio of the used slurry kept on the polishing pad 100. This enables the used slurry to be reused for polishing the substrate and reduces the use amount of the slurry.

When the derivative value of the polishing rate has a negative value and becomes equal to the set lower limit value V'min again (FIG. 26(C), at the time t=t3), the controller 200 determines that the used slurry becomes old/deteriorates and changes the angle θs of the polishing solution supply device 41 to θdis (0<θdis≤45 degrees). This accelerates discharge of the used slurry. After that, the controller 200 repeatedly changes over the setting of the angle θs between θdis and θrec, based on the derivative value of the polishing rate. The configuration of monitoring the derivative value of the polishing rate enables the setting of the angle to be changed over between acceleration of discharge of the used slurry and acceleration of reuse of the used slurry, based on the actual state of the used slurry, and enhances the compatibility between reduction of the use amount of the slurry and maintenance of the polishing quality. A modification of this example may change the angle when the state that the derivative value V of the polishing rate satisfies the above condition (is equal to or lower than the lower limit value V'min or is equal to 0) continues for a predetermined time period.

The foregoing example describes the derivative value as an example of the parameter indicating a time change of the polishing rate. Another parameter indicating a time change of the polishing rate may be used instead. The angle θs may be controlled by a combination of the polishing rate with a parameter indicating a time change of the polishing rate.

(Modifications)

(1) The above embodiment describes the configuration of changing over the angle of the polishing solution supply device 4 or 41 between two angles. A modification may change over the angle of the polishing solution supply device 4 or 41 between three or more angles. Another modification may change the angle of the polishing solution supply device 4 or 41 stepwise or continuously in a direction of accelerating/suppressing discharge of the polishing solution, based on the polishing rate (or based on a time change of the polishing rate).

(2) The above embodiment employs the motor as the rotating mechanism of the polishing solution supply device 4 or 41. The rotating mechanism employed may, however, be any actuator other than the motor, as long as the actuator is configured to rotate the polishing solution supply device 4 or 41 with respect to the arm 60.

(3) According to the embodiment described above, the polishing solution supply device 4 or 41 is configured to have the bottom face that comes into contact with the polishing pad. According to a modification, the polishing solution supply device may be provided with a frame body without a bottom face and may be configured to drop the polishing solution inside of the frame body and spread the polishing solution on the polishing pad from a clearance between the frame body and the polishing pad. A cover member may be located above the frame body and may be provided with a supply port of the polishing solution. This configuration causes the polishing solution to be supplied directly from a nozzle to inside of the frame body. The nozzle is preferably configured to move in conjunction with rotation and move of the polishing solution supply device.

(4) The above embodiment employs the motor as the rotating mechanism of the polishing solution supply device 4 or 41. According to a modification, the polishing solution supply device may be mounted at any arbitrary angle θs prior to a start of polishing without using a rotating mechanism such as a motor. In this modification, the angle control of accelerating/suppressing discharge of the polishing solution is not performed during polishing. For example, the polishing solution supply device 4 or 41 may be fixed to the arm 60 to have a desired angle θs with respect to the arm 60 at a polishing solution supply position. A fixation structure between the polishing solution supply device 4 or 41 and the arm 60 may be configured to continuously or discretely adjust the angle of the polishing solution supply device 4 or 41 with respect to the arm 60 and subsequently fix the polishing solution supply device 4 or 41 to the arm 60 by screwing or the like.

At least the following aspects are provided from the embodiments described above.

According to a first aspect, there is provided a polishing apparatus configured to polish an object by using a polishing pad having a polishing surface. The polishing apparatus comprises: a polishing table provided to be rotatable and configured to support and rotate the polishing pad; a holder configured to hold the object and press the object against the polishing pad; a polishing solution supply device provided with a contact member and configured to supply a polishing solution to an opening in a bottom face of the contact member in a state that the contact member comes into contact with or is adjacent to the polishing pad, thereby spreading the polishing solution on the polishing pad, the polishing solution supply device causing at least part of used polishing solution returned by rotation of the polishing pad to be dammed up by the contact member and setting the contact member either in a direction of keeping the dammed up polishing solution on the polishing pad or in a direction of discharging the dammed up polishing solution, according to an angle of the polishing solution supply device with respect to a radial direction of the polishing pad; an arm linked with the polishing solution supply device; a rotating mechanism configured to rotate the polishing solution supply device with respect to the arm; and a controller configured to control the rotating mechanism to change the angle of the polishing solution supply device with respect to the radial direction of the polishing pad and thereby control a discharge amount of the polishing solution by the contact member of the polishing solution supply device.

The polishing apparatus of this aspect enables the angle of the polishing solution supply device (the contact member or more specifically a rear wall of the contact member) to be adjusted to a desired angle with respect to the radial direction (or the rotating direction) of the polishing pad by the rotating mechanism. Changing the angle of the polishing solution supply device on the polishing pad controls discharge of the polishing solution (and/or the fluid on the polishing pad) by the polishing solution supply device (the contact member). Performing control of suppressing discharge of the relatively fresh polishing solution having the polishing performance (including the case of no discharge by the contact member) enables the polishing solution having the polishing performance to be more efficiently used (for example, suppresses discharge of the polishing solution during pre-supply or reuses the polishing solution during polishing) and reduces the use amount of the polishing solution. Performing control of accelerating discharge of the deteriorating polishing solution, on the other hand, suppresses the deteriorating polishing solution from being used for polishing the object and thereby suppresses deterioration of the polishing quality. Accordingly, changing the angle of the polishing solution supply device on the polishing pad can reduce the use amount of the polishing solution and/or can suppress deterioration of the polishing quality.

According to a second aspect, the polishing apparatus of the first aspect described above may further comprise a lifting turning mechanism configured to lift up and lower and turn the arm. In this polishing apparatus, the controller may be configured to change an angle and/or a position of the polishing solution supply device on the polishing pad by combination of rotation of the polishing solution supply device by the rotating mechanism with turning of the arm by the lifting turning mechanism.

The configuration of this aspect combines rotation of the polishing solution supply device with turning of the arm and can thus change the angle of the polishing solution supply device to a desired angle and readily make the position of the polishing solution supply device to approach a desired position. The desired position is, for example, a position that has a small change in dropping position of the polishing solution (the position of the supply port) from the polishing solution supply device after the angle change, a position that minimizes a distance between the dropping position of the polishing solution (the position of the supply port) and the center of the polishing pad after the angle change, or a position that keeps constant or maximizes an interval (clearance) between the polishing solution supply device and the holder (top ring) of the object after the angle change. The first position or the second position may be a position that does not make the interval between the polishing solution supply device and the holder of the object smaller than a predetermined value (i.e., a position in a range where the interval is equal to or larger than the predetermined value or a position where the interval is kept constant). The predetermined value is a value larger than zero.

According to a third aspect, in the polishing apparatus of either the first aspect or the second aspect described above, the controller may set the angle of the polishing solution supply device to a first angle during a pre-supply that supplies the polishing solution to the polishing pad prior to polishing of the object, and may set the angle of the polishing solution supply device to a second angle that accelerates discharge of the polishing solution compared with the first angle, for at least part of a time period of polishing of the object.

The configuration of this aspect suppresses discharge of the polishing solution having the polishing performance during the pre-supply of the polishing solution when polishing of the object is not performed and thereby reduces the use amount of the polishing solution. The configuration of this aspect accelerates discharge of the polishing solution as needed basis during polishing of the object and thereby suppresses deterioration of the polishing quality.

According to a fourth aspect, in the polishing apparatus of either the first aspect or the second aspect described above, the controller may set the angle of the polishing solution supply device to a third angle for a predetermined time period before a start of a pre-supply that supplies the polishing solution to the polishing pad prior to polishing of the object, and may set the angle of the polishing solution supply device to a fourth angle that suppresses discharge of the polishing solution compared with the third angle, during the pre-supply. The configuration of the third aspect may be combined with the configuration of the fourth aspect. In this case, the second angle is equal to the fourth angle.

The configuration of this aspect accelerates discharge of the fluid on the polishing pad by rotation of the polishing pad, before a start of the pre-supply of the polishing solution and thereby enables the pre-supply of the polishing solution to be started in the state that the excess fluid on the polishing pad is removed. This configuration is effective, for example, in the case of using a polishing pad having a poor drainage. This configuration also suppresses discharge of the relatively fresh polishing solution during the pre-supply and thereby reduces the use amount of the polishing solution.

According to a fifth aspect, in the polishing apparatus of any one of the first to the fourth aspects described above, the controller may change over the angle of the polishing solution supply device between a plurality of different angles during polishing of the object. For example, the angle of the polishing solution supply device may be changed over between a plurality of different angles once, multiple times or repeatedly, based on a set time interval and/or a measurement value (for example, a polishing rate) by a sensor.

The configuration of this aspect enables the angle of the polishing solution supply device to be changed over between an angle of accelerating discharge of the polishing solution and an angle of suppressing discharge of the polishing solution, during polishing of the object. While the polishing solution is fresh (reusable), this configuration suppresses discharge of the polishing solution but reuses the polishing solution, thus reducing the use amount of the polishing solution. When the polishing solution deteriorates, this configuration accelerates discharge of the polishing solution and thereby suppresses deterioration of the polishing quality. This configuration accordingly achieves both reduction of the use amount of the polishing solution and suppression of deterioration of the polishing quality. The angle of the polishing solution supply device may be changed over by increasing/decreasing the angle stepwise or continuously, so as to change the degree of accelerating/suppressing discharge of the polishing solution stepwise or continuously.

According to a sixth aspect, in the polishing apparatus of any one of the first to the fifth aspects described above, the controller may change the angle of the polishing solution supply device, based on a polishing rate and/or a time change of the polishing rate, during polishing of the object. The time change of the polishing rate is, for example, a time rate of change, such as a derivative value, of the polishing rate.

The configuration of this aspect determines the actual state of the polishing solution, based on the polishing rate and/or a time change of the polishing rate and controls acceleration/suppression of discharge of the polishing solution. Accordingly, this configuration achieves both reduction of the use amount of the polishing solution and suppression of deterioration of the polishing quality with high accuracy, based on the actual state of the polishing solution.

According to a seventh aspect, the polishing apparatus of the sixth aspect described above may further comprise a film thickness sensor placed in the polishing table and configured to measure a film thickness distribution on a surface of the object. In this polishing apparatus, the controller may calculate the polishing rate from a time change of the film thickness distribution at a time of polishing the object obtained by the film thickness sensor.

The configuration of this aspect uses the film thickness sensor for real-time measurement of the film thickness distribution of the object during polishing and calculates a real-time polishing rate and/or a real-time change of the polishing rate.

According to an eighth aspect, in the polishing apparatus of the second aspect or any one of the third to the seventh aspects depending directly or indirectly on the second aspect, the polishing solution supply device may have a supply port from which the polishing solution is supplied onto the polishing pad, and the controller may control the angle and/or the position of the polishing solution supply device such as to minimize a change in position of the supply port before and after a change of the angle of the polishing solution supply device.

The configuration of this aspect reduces a deviation in dropping position of the polishing solution before and after a change of the angle of the polishing solution supply device and thereby suppresses a variation in a supply range of the polishing solution to the object. This suppresses a variation in supply amount and/or a supply range of the polishing solution to the object before and after a change of the angle of the polishing solution supply device.

According to a ninth aspect, in the polishing apparatus of the second aspect or any one of the third to the seventh aspects depending directly or indirectly on the second aspect, the polishing solution supply device may have a supply port from which the polishing solution is supplied onto the polishing pad, and the controller may control the angle and/or the position of the polishing solution supply device such as to minimize a distance between position of the supply port and center of the polishing pad before and after a change of the angle of the polishing solution supply device. The distance between the position of the supply port and the center of the polishing pad may be, for example, a distance between the center of the supply port and the center of the polishing pad or may be a shortest distance between the supply port and the center of the polishing pad.

The configuration of this aspect suppresses the dropping position of the polishing solution from becoming farther away from the center of the polishing pad before and after a change of the angle of the polishing solution supply device and thereby enables the polishing solution to be readily supplied to the entire polishing pad.

According to a tenth aspect, in the polishing apparatus of the second aspect or any one of the third to the seventh aspects depending directly or indirectly on the second aspect, the controller may control the lifting turning mechanism and the rotating mechanism such as to move the arm, while keeping the angle of the polishing solution supply device constant.

The configuration of this aspect enables the polishing solution supply device to be scanned on the polishing pad at a constant angle.

According to an eleventh aspect, in the polishing apparatus of any one of the eighth to the tenth aspects described above, the controller may control the lifting turning mechanism and the rotating mechanism in a range that an interval between the polishing solution supply device and the holder is equal to or larger than a predetermined value. The predetermined value is a value larger than zero.

The configuration of this aspect enables the above control to be performed, while reliably avoiding the polishing solution supply device from coming into contact with the holder of the object.

According to a twelfth aspect, in the polishing apparatus of the second aspect or any one of the third to the seventh aspects depending directly or indirectly on the second aspect, the controller may control the lifting turning mechanism and the rotating mechanism such as to keep an interval between the polishing solution supply device and the holder constant before and after a change of the angle of the polishing solution supply device.

The configuration of this aspect keeps the clearance between the polishing solution supply device and the holder of the object constant before and after a change of the angle of the polishing solution supply device. This reliably suppresses the polishing solution supply device from coming into contact with the holder of the object.

According to a thirteenth aspect, in the polishing apparatus of the second aspect or any one of the third to the seventh aspects depending directly or indirectly on the second aspect, the controller may change a sequence of performing rotation of the arm by the lifting turning mechanism and rotation of the polishing solution supply device by the rotating mechanism according to angles before and after a change of the angle of the polishing solution supply device.

The configuration of this aspect changes the angle and/or the position of the polishing solution supply device with changing the sequence of performing the rotation of the arm and the rotation of the polishing solution supply device with respect to the arm, such as to prevent the polishing solution supply device from coming into contact with the holder of the object. This configuration prevents the polishing solution supply device from coming into contact with the holder of the object.

According to a fourteenth aspect, in the polishing apparatus of the second aspect or any one of the third to the seventh aspects depending directly or indirectly on the second aspect, after termination of polishing of the object, the controller may cause the arm to be rotated by the lifting turning mechanism, subsequently cause the polishing solution supply device to be rotated to an angle for retreating by the rotating mechanism, subsequently rotate the arm, and move the polishing solution supply device to a refuge position outside of the polishing pad.

When the polishing solution supply device is to be retreated after termination of polishing, the configuration of this aspect rotates the arm such as to make the polishing solution supply device away from the holder of the object and subsequently rotates the polishing solution supply device to the angle for retreating. This configuration prevents the polishing solution supply device from coming into contact with the holder of the object.

According to a fifteenth aspect, in the polishing apparatus of the second aspect or any one of the third to the seventh aspects depending directly or indirectly on the second aspect, the rotating mechanism may include a motor fixed to the arm, and the polishing solution supply device may be mounted to a rotating shaft of the motor.

This aspect enables the rotating mechanism of the polishing solution supply device to be implemented by the simple configuration.

According to a sixteenth aspect, there is provided a polishing method of polishing an object by using a polishing pad having a polishing surface and a polishing solution supply device placed on the polishing pad. The polishing method comprises: supplying a polishing solution to an opening in a bottom face of a contact member of the polishing solution supply device to spread the polishing solution on the polishing pad in a state that the contact member comes into contact with or is adjacent to the polishing pad, causing at least part of used polishing solution returned by rotation of the polishing pad to be dammed up by the contact member, and keeping the dammed up polishing solution on the polishing pad and/or discharging the dammed up polishing solution, according to an angle of the polishing solution supply device with respect to a radial direction of the polishing pad; and controlling a discharge amount of the polishing solution by changing an angle and/or a position of the polishing solution supply device on the polishing pad, at least at a time of a pre-supply that supplies the polishing solution to the polishing pad prior to polishing of the object, or during polishing of the object.

The polishing method of this aspect changes the angle and/or the position of the polishing solution supply device (the contact member or more specifically a rear wall of the contact member) on the polishing pad at least at the time of the pre-supply that supplies the polishing solution to the polishing pad prior to polishing of the object, or during polishing of the object. This controls discharge of the polishing solution on the polishing pad. Performing control of suppressing discharge of the relatively fresh polishing solution having the polishing performance (including the case of no discharge by the contact member) enables the polishing solution having the polishing performance to be more efficiently used (for example, suppresses discharge of the polishing solution during pre-supply or reuses the polishing solution during polishing) and reduces the use amount of the polishing solution. Performing control of accelerating discharge enables the fluid on the polishing pad to be discharged prior to the pre-supply and/or suppresses the deteriorating polishing solution from being used for polishing the object and thereby suppresses deterioration of the polishing quality. Accordingly, changing the angle and/or the position of the polishing solution supply device (the contact member) on the polishing pad in the polishing process can reduce the use amount of the polishing solution and/or can suppress deterioration of the polishing quality.

According to a seventeenth aspect, the polishing method of the sixteenth aspect may comprise changing the angle and/or the position of the polishing solution supply device on the polishing pad by rotation of an arm linked with the polishing solution supply device and/or rotation of the polishing solution supply device with respect to the arm.

The configuration of this aspect has similar functions and advantageous effects to the functions and the advantageous effects described above with regard to the configuration of the second aspect.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit respective constituent elements described in the claims and the specification in a range where at least a part of the above-mentioned problem can be solved or a range where at least a part of the effect is exhibited.

The present application claims priorities from the Japanese patent application No. 2020-83404 filed on May 11, 2020. The entire disclosures of the Japanese patent application No. 2020-83404 filed on May 11, 2020, including the specifications, the claims, the drawings and the abstracts are incorporated herein by reference in their entireties.

The entire disclosures of Japanese Unexamined Patent Publication No. H10-217114 (Patent Document 1), Japanese Patent No. 2903980 (Patent Document 2), Japanese Unexamined Patent Publication No. H11-114811 (Patent Document 3), Japanese Unexamined Patent Publication No. 2019-520991 (Patent Document 4), and U.S. Pat. No. 8,845,395 (Patent Document 5), including the specifications, the claims, the drawings and the abstracts are incorporated herein by reference in their entireties.

REFERENCE SIGNS LIST

| | |
|---|---|
| 1 | polishing apparatus |
| 20 | polishing table |
| 30 | top ring |
| 40 | polishing solution supply system |
| 41 | polishing solution supply device |
| 45 | following mechanism |
| 46 | suspending mechanism |
| 50 | atomizer |
| 60 | arm |
| 60a | leading end side portion |
| 60b | base end portion |
| 70 | lifting turning mechanism |
| 71 | waterproof box |
| 72 | waterproof box |
| 80 | lifting mechanism |
| 81 | lift cylinder |
| 82 | axis |
| 83 | ball spline |
| 84 | axis |
| 85 | frame |
| 86 | sensor |
| 90 | turning mechanism |
| 92 | shaft |
| 93 | motor |
| 100 | polishing pad |
| 102 | polishing surface |
| 120 | polishing solution supply line |
| 130 | fluid line |
| 140 | electric cable |
| 200 | controller |
| 210 | end point detection device |
| 410 | contact member |
| 411 | front wall |

-continued

| | |
|---|---|
| 412 | rear wall |
| 414 | supply port |
| 418 | bottom face |
| 419 | slit |
| 421 | O-ring |
| 422 | packing |
| 423 | weight |
| 424 | through hole |
| 430 | cover |
| 431 | through hole |
| 434 | bracket |
| 435 | mounting portion |
| 450 | arm-side stopper |
| 451 | upper face |
| 451a | stepped face (stopper face) |
| 452 | through hole |
| 454 | shaft |
| 455 | pad-side stopper |
| 460 | spherical joint assembly |
| 461a | housing |
| 461b | spherical joint |
| 462 | arm |
| 463 | retainer-stopper |
| 464 | groove |
| 465 | rod |
| 466 | rod end |
| 466a | spherical joint |
| 467 | shaft |
| 480 | motor |
| 481 | rotating shaft |

What is claimed is:

1. An apparatus for polishing configured to polish an object by using a polishing pad having a polishing surface, the apparatus comprising:

a polishing table provided to be rotatable and configured to support and rotate the polishing pad;

a holder configured to hold the object and press the object against the polishing pad;

a polishing solution supply device provided with a plate-like contact member and configured to supply a polishing solution to an opening in a bottom face of the contact member in a state that the contact member comes into contact with or is adjacent to the polishing pad, thereby spreading the polishing solution on the polishing pad, the polishing solution supply device causing at least part of used polishing solution returned by rotation of the polishing pad to be dammed up by the contact member and setting the contact member either in a direction of keeping the dammed up polishing solution on the polishing pad or in a direction of discharging the dammed up polishing solution, according to an angle of the polishing solution supply device with respect to a radial direction of the polishing pad;

an arm linked with the polishing solution supply device at one end of the arm;

a motor fixed to the one end of the arm and including a rotating shaft to which the polishing solution supply device is directly or indirectly fixed, the rotating shaft being perpendicular to the polishing surface, the motor configured to rotate the polishing solution supply device with respect to the arm and parallel to the polishing surface; and a controller configured to control the motor to change the angle of the polishing solution supply device with respect to the radial direction of the polishing pad and thereby control a discharge amount of the polishing solution by the contact member of the polishing solution supply device.

2. The apparatus according to claim 1, further comprising:

a lifting turning mechanism configured to lift up and lower and turn the arm, wherein the controller is configured to change an angle and/or a position of the polishing solution supply device on the polishing pad by combination of rotation of the polishing solution supply device by the motor with turning of the arm by the lifting turning mechanism.

3. The apparatus according to claim 1, wherein the controller sets the angle of the polishing solution supply device to a first angle during a pre-supply that supplies the polishing solution to the polishing pad prior to polishing of the object, and sets the angle of the polishing solution supply device to a second angle that accelerates discharge of the polishing solution compared with the first angle, for at least part of a time period of polishing of the object.

4. The apparatus according to claim 1, wherein the controller sets the angle of the polishing solution supply device to a third angle for a predetermined time period before a start of a pre-supply that supplies the polishing solution to the polishing pad prior to polishing of the object, and sets the angle of the polishing solution supply device to a fourth angle that suppresses discharge of the polishing solution compared with the third angle, during the pre-supply.

5. The apparatus according to claim 1, wherein the controller changes over the angle of the polishing solution supply device to a plurality of different angles during polishing of the object.

6. The apparatus according to claim 1, wherein the controller changes the angle of the polishing solution supply device, based on a polishing rate and/or a time change of the polishing rate, during polishing of the object.

7. The apparatus according to claim 6, further comprising:

a film thickness sensor placed in the polishing table and configured to measure a film thickness distribution on a surface of the object, wherein the controller calculates the polishing rate from a time change of the film thickness distribution at a time of polishing the object obtained by the film thickness sensor.

8. The apparatus according to claim 2, wherein the polishing solution supply device has a supply port from which the polishing solution is supplied onto the polishing pad, and the controller controls the angle and/or the position of the polishing solution supply device such as to minimize a change in position of the supply port before and after a change of the angle of the polishing solution supply device.

9. The apparatus according to claim 8, wherein the controller controls the lifting turning mechanism and theg motor in a range that an interval between the polishing solution supply device and the holder is equal to or larger than a predetermined value.

10. The apparatus according to claim 2, wherein the polishing solution supply device has a supply port from which the polishing solution is supplied onto the polishing pad, and the controller controls the angle and/or the position of the polishing solution supply device such as to minimize a distance between position of the supply port and center of the polishing pad before and after a change of the angle of the polishing solution supply device.

11. The apparatus according to claim 2, wherein the controller controls the lifting turning mechanism and the motor such as to move the arm, while keeping the angle of the polishing solution supply device constant.

12. The apparatus according to claim 2, wherein the controller controls the lifting turning mechanism and the motor such as to keep an interval between the polishing solution supply device and the holder constant before and after a change of the angle of the polishing solution supply device.

13. The apparatus according to claim 2, wherein the controller changes a sequence of performing rotation of the arm by the lifting turning mechanism and rotation of the polishing solution supply device by the motor according to angles before and after a change of the angle of the polishing solution supply device.

14. The apparatus according to claim 2, wherein after termination of polishing of the object, the controller causes the arm to be rotated by the lifting turning mechanism, subsequently causes the polishing solution supply device to be rotated to an angle for retreating by the motor, subsequently rotates the arm, and moves the polishing solution supply device to a refuge position outside of the polishing pad.

15. A method of polishing an object by using a polishing pad having a polishing surface and a polishing solution supply device linked with an arm at one end of the arm and placed on the polishing pad, the method of polishing comprising:

supplying a polishing solution to an opening in a bottom face of a plate-like contact member of the polishing solution supply device to spread the polishing solution on the polishing pad in a state that the contact member comes into contact with or is adjacent to the polishing pad, causing at least part of used polishing solution returned by rotation of the polishing pad to be dammed up by the contact member, and keeping the dammed up polishing solution on the polishing pad and/or discharging the dammed up polishing solution, according to an angle of the polishing solution supply device with respect to a radial direction of the polishing pad; and controlling a discharge amount of the polishing solution by changing an angle of the polishing solution supply device with respect to the radial direction of the polishing pad and/or a position of the polishing solution supply device on the polishing pad, at least at a time of a pre-supply that supplies the polishing solution to the polishing pad prior to polishing of the object, or during polishing of the object, wherein changing the angle of the polishing solution supply device with respect to the radial direction of the polishing pad and/or the position of the polishing solution supply device on the polishing pad includes rotating a rotating shaft of a motor fixed to the one end of the arm, the rotating shaft being perpendicular to the polishing surface, thereby to rotate the polishing solution supply device fixed directly or indirectly to the rotating shaft, with respect to the arm and parallel to the polishing surface.

16. The method according to claim 15, wherein changing the angle of the polishing solution supply device with respect to the radial direction of the polishing pad and/or the position of the polishing solution supply device on the polishing pad further includes rotating the arm.

* * * * *